US011469526B2

(12) United States Patent
Ma et al.

(10) Patent No.: US 11,469,526 B2
(45) Date of Patent: Oct. 11, 2022

(54) ELECTRONIC DEVICES HAVING MULTIPLE PHASED ANTENNA ARRAYS

(71) Applicant: Apple Inc., Cupertino, CA (US)

(72) Inventors: Kexin Ma, San Diego, CA (US); Siwen Yong, Mountain View, CA (US); Jiangfeng Wu, San Jose, CA (US); Simon G. Begashaw, Santa Clara, CA (US); Madhusudan Chaudhary, Campbell, CA (US); Lijun Zhang, Los Gatos, CA (US); Yi Jiang, Cupertino, CA (US); Hao Xu, Cupertino, CA (US); Mattia Pascolini, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 4 days.

(21) Appl. No.: 17/031,780

(22) Filed: Sep. 24, 2020

(65) Prior Publication Data

US 2022/0094078 A1 Mar. 24, 2022

(51) Int. Cl.

| | |
|---|---|
| ***H01Q 21/28*** | (2006.01) |
| ***H01Q 1/22*** | (2006.01) |
| ***H01Q 3/26*** | (2006.01) |

(52) U.S. Cl.

CPC ..... *H01Q 21/28* (2013.01); *H01Q 1/2208* (2013.01); *H01Q 3/2617* (2013.01)

(58) Field of Classification Search

CPC .... H01Q 1/243; H01Q 3/2606; H01Q 3/2635; H01Q 21/065; H01Q 1/38; H01Q 21/28; H01Q 1/2283; H01Q 3/36; H01Q 1/2266; H01Q 23/00; H01Q 21/0025; H01Q 3/267; H01Q 25/00; H01Q 21/00; H01Q 21/061; H01Q 1/523; H01Q 3/2617; H01Q 3/2623;

(Continued)

(56) References Cited

U.S. PATENT DOCUMENTS

| | | | |
|---|---|---|---|
| 6,922,173 | B2 | 7/2005 | Anderson |
| 6,965,355 | B1 | 11/2005 | Durham et al. |

(Continued)

OTHER PUBLICATIONS

Semkin, et al.. Beam Switching Conformal Antenna Array for mm-Wave Communications, Apr. 27, 2015, IEEE Antennas and Wireless Propagation Letters, pp. 28-31, vol. 15, IEEE.

*Primary Examiner* — Dameon E Levi
*Assistant Examiner* — Leah Rosenberg
(74) *Attorney, Agent, or Firm* — Treyz Law Group, P.C.; Michael H. Lyons; Tianyi He

(57) ABSTRACT

An electronic device may include first and second phased antenna arrays that convey radio-frequency signals at frequencies greater than 10 GHz. The second array may have fewer antennas than the first array. Control circuitry may control the first and second arrays in a diversity mode and in a simultaneous array mode. In the diversity mode, the first array may form a first signal beam while the second array is inactive. When the first array is blocked by an object or otherwise exhibits unsatisfactory performance, the second array may form a second signal beam while the first array is inactive. In the simultaneous mode, the first and second arrays may form a combined array that produces a third signal beam. The combined array may maximize gain. Hierarchical beam searching operations may be performed. The arrays may be distributed across one or more modules.

18 Claims, 16 Drawing Sheets

(58) Field of Classification Search
CPC ..... H01Q 3/2629; H01Q 3/2658; H01Q 3/22; H01Q 3/24; H01Q 1/2208; H01Q 1/22; H04B 7/0617; H04B 7/0603; H04B 7/0695; H04B 7/0814; H04B 7/04; H04B 7/0408; H04B 7/0413; H04B 17/318; H04B 7/0689; H04B 7/0802; H04B 7/0871; H04B 7/088
See application file for complete search history.

(56) References Cited

U.S. PATENT DOCUMENTS

| | | | | |
|---|---|---|---|---|
| 8,023,913 | B2 * | 9/2011 | Cavin | H03L 7/23 455/426.2 |
| 8,836,574 | B2 | 9/2014 | Grau Besoli et al. | |
| 9,160,430 | B2 * | 10/2015 | Maltsev | H04B 7/0885 |
| 9,667,290 | B2 | 5/2017 | Ouyang et al. | |
| 9,972,892 | B2 | 5/2018 | Noori et al. | |
| 10,418,687 | B2 * | 9/2019 | Mow | H01Q 1/243 |
| 10,712,440 | B2 | 7/2020 | Daniel et al. | |
| 10,720,979 | B1 * | 7/2020 | Paulotto | H04B 7/0617 |
| 2013/0308717 | A1 * | 11/2013 | Maltsev | H01Q 3/36 375/267 |
| 2018/0309473 | A1 * | 10/2018 | Chayat | H04B 17/21 |
| 2019/0131691 | A1 * | 5/2019 | Hong | H01Q 21/28 |
| 2019/0150003 | A1 * | 5/2019 | He | H04B 7/086 342/368 |
| 2019/0363439 | A1 | 11/2019 | Thalakotuna et al. | |
| 2021/0028540 | A1 * | 1/2021 | Rom | H01Q 3/24 |
| 2021/0044026 | A1 * | 2/2021 | Cho | H01Q 1/245 |
| 2021/0159596 | A1 * | 5/2021 | Park | H01Q 3/247 |

* cited by examiner

ELECTRONIC DEVICES HAVING MULTIPLE PHASED ANTENNA ARRAYS

BACKGROUND

This relates generally to electronic devices and, more particularly, to electronic devices with wireless communications circuitry.

Electronic devices often include wireless communications circuitry. For example, cellular telephones, computers, and other devices often contain antennas and wireless transceivers for supporting wireless communications.

It may be desirable to support wireless communications in millimeter wave and centimeter wave communications bands. Millimeter wave communications, which are sometimes referred to as extremely high frequency (EHF) communications, and centimeter wave communications involve communications at frequencies of about 10-300 GHz. Operation at these frequencies can support high throughputs but may raise significant challenges. For example, radio-frequency signals at millimeter and centimeter wave frequencies can be characterized by substantial attenuation and/or distortion during signal propagation through various mediums.

It would therefore be desirable to be able to provide electronic devices with improved wireless communications circuitry such as communications circuitry that supports millimeter and centimeter wave communications.

SUMMARY

An electronic device may be provided with wireless circuitry and a housing. The housing may have a housing wall. The wireless circuitry may include first and second phased antenna arrays that convey radio-frequency signals at a frequency greater than 10 GHz through the housing wall. The second phased antenna array may have fewer antennas than the first phased antenna array.

Control circuitry may control the first and second phased antenna arrays in a diversity mode of operation and in a simultaneous array mode of operation. In the diversity mode of operation, the control circuitry may control the first phased antenna array to form a first signal beam while the second phased antenna array is inactive. When the first phased antenna array is being blocked by an external object or otherwise exhibits unsatisfactory wireless performance, the control circuitry may control the second phased antenna array to form a second signal beam while the first phased antenna array is inactive. In the simultaneous mode of operation, the control circuitry may control the first and second phased antenna arrays to form a combined phased antenna array that produces a third signal beam. The control circuitry may use the combined phased antenna array to maximize gain and beam resolution. The control circuitry may perform a hierarchical beam searching operation using single-array signal beams and then signal beams of the combined phased antenna array. The first and second phased antenna arrays may be distributed across one or more antenna modules. The antenna modules may be mounted to and/or external to a main logic board. If desired, one of the antenna modules may produce a local oscillator signal that is provided to the other antenna module(s).

DETAILED DESCRIPTION

Figure 1:
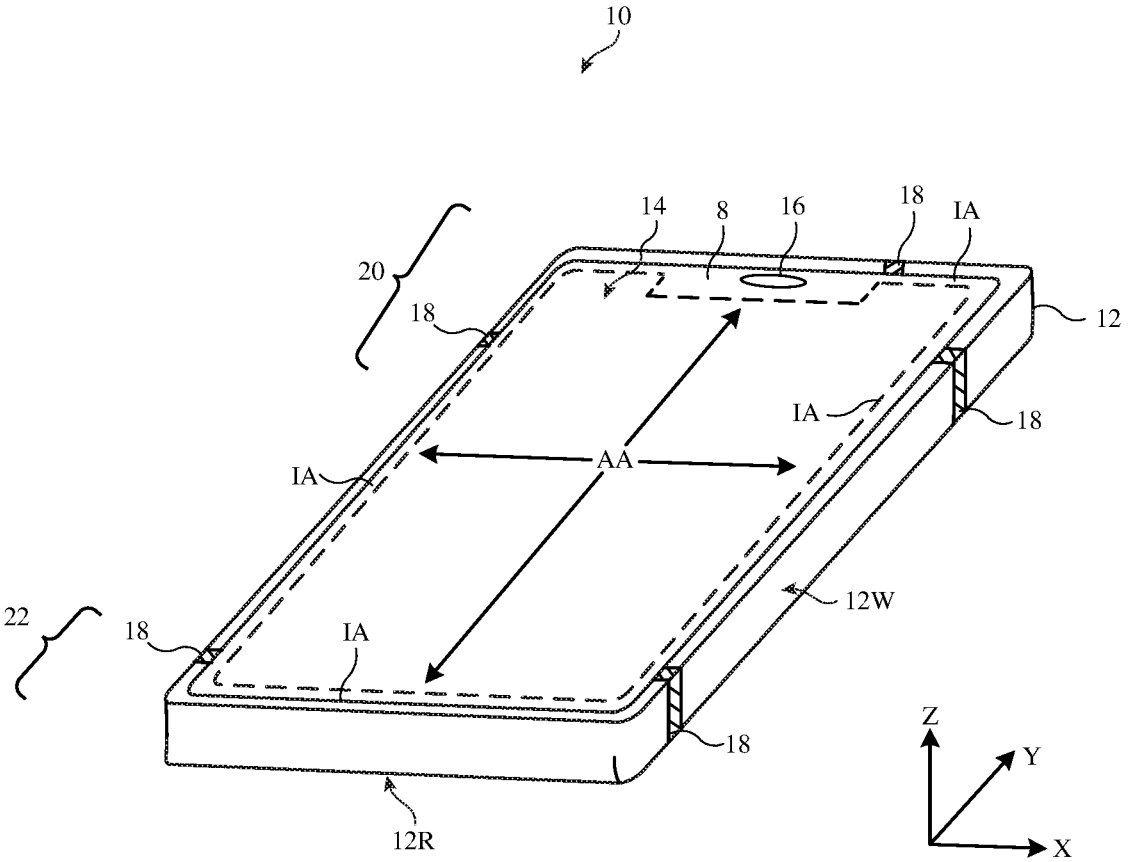
FIG. 1 is a perspective view of an illustrative electronic device in accordance with some embodiments.

An electronic device such as electronic device 10 of FIG. 1 may be provided with wireless circuitry that includes antennas. The antennas may be used to transmit and/or receive wireless radio-frequency signals. The antennas may include phased antenna arrays that are used for performing wireless communications and/or spatial ranging operations using millimeter and centimeter wave signals. Millimeter wave signals, which are sometimes referred to as extremely high frequency (EHF) signals, propagate at frequencies above about 30 GHz (e.g., at 60 GHz or other frequencies between about 30 GHz and 300 GHz). Centimeter wave signals propagate at frequencies between about 10 GHz and 30 GHz. If desired, device 10 may also contain antennas for handling satellite navigation system signals, cellular telephone signals, local wireless area network signals, near-field communications, light-based wireless communications, or other wireless communications.

Device 10 may be a portable electronic device or other suitable electronic device. For example, device 10 may be a laptop computer, a tablet computer, a somewhat smaller device such as a wrist-watch device, pendant device, headphone device, earpiece device, headset device, or other wearable or miniature device, a handheld device such as a cellular telephone, a media player, or other small portable device. Device 10 may also be a set-top box, a desktop computer, a display into which a computer or other processing circuitry has been integrated, a display without an integrated computer, a wireless access point, a wireless base station, an electronic device incorporated into a kiosk, building, or vehicle, or other suitable electronic equipment.

Device 10 may include a housing such as housing 12. Housing 12, which may sometimes be referred to as a case, may be formed of plastic, glass, ceramics, fiber composites, metal (e.g., stainless steel, aluminum, etc.), other suitable materials, or a combination of these materials. In some situations, parts of housing 12 may be formed from dielectric or other low-conductivity material (e.g., glass, ceramic, plastic, sapphire, etc.). In other situations, housing 12 or at least some of the structures that make up housing 12 may be formed from metal elements.

Device 10 may, if desired, have a display such as display 14. Display 14 may be mounted on the front face of device 10. Display 14 may be a touch screen that incorporates capacitive touch electrodes or may be insensitive to touch. The rear face of housing 12 (i.e., the face of device 10 opposing the front face of device 10) may have a substantially planar housing wall such as rear housing wall 12R (e.g., a planar housing wall). Rear housing wall 12R may have slots that pass entirely through the rear housing wall and that therefore separate portions of housing 12 from each other. Rear housing wall 12R may include conductive portions and/or dielectric portions. If desired, rear housing wall 12R may include a planar metal layer covered by a thin layer or coating of dielectric such as glass, plastic, sapphire, or ceramic (e.g., a dielectric cover layer). Housing 12 may also have shallow grooves that do not pass entirely through housing 12. The slots and grooves may be filled with plastic or other dielectric materials. If desired, portions of housing 12 that have been separated from each other (e.g., by a through slot) may be joined by internal conductive structures (e.g., sheet metal or other metal members that bridge the slot).

Housing 12 may include peripheral housing structures such as peripheral structures 12W. Conductive portions of peripheral structures 12W and conductive portions of rear housing wall 12R may sometimes be referred to herein collectively as conductive structures of housing 12. Peripheral structures 12W may run around the periphery of device 10 and display 14. In configurations in which device 10 and display 14 have a rectangular shape with four edges, peripheral structures 12W may be implemented using peripheral housing structures that have a rectangular ring shape with four corresponding edges and that extend from rear housing wall 12R to the front face of device 10 (as an example). In other words, device 10 may have a length (e.g., measured parallel to the Y-axis), a width that is less than the length (e.g., measured parallel to the X-axis), and a height (e.g., measured parallel to the Z-axis) that is less than the width. Peripheral structures 12W or part of peripheral structures 12W may serve as a bezel for display 14 (e.g., a cosmetic trim that surrounds all four sides of display 14 and/or that helps hold display 14 to device 10) if desired. Peripheral structures 12W may, if desired, form sidewall structures for device 10 (e.g., by forming a metal band with vertical sidewalls, curved sidewalls, etc.).

Peripheral structures 12W may be formed of a conductive material such as metal and may therefore sometimes be referred to as peripheral conductive housing structures, conductive housing structures, peripheral metal structures, peripheral conductive sidewalls, peripheral conductive sidewall structures, conductive housing sidewalls, peripheral conductive housing sidewalls, sidewalls, sidewall structures, or a peripheral conductive housing member (as examples). Peripheral conductive housing structures 12W may be formed from a metal such as stainless steel, aluminum, alloys, or other suitable materials. One, two, or more than two separate structures may be used in forming peripheral conductive housing structures 12W.

It is not necessary for peripheral conductive housing structures 12W to have a uniform cross-section. For example, the top portion of peripheral conductive housing structures 12W may, if desired, have an inwardly protruding ledge that helps hold display 14 in place. The bottom portion of peripheral conductive housing structures 12W may also have an enlarged lip (e.g., in the plane of the rear surface of device 10). Peripheral conductive housing structures 12W may have substantially straight vertical sidewalls, may have sidewalls that are curved, or may have other suitable shapes. In some configurations (e.g., when peripheral conductive housing structures 12W serve as a bezel for display 14), peripheral conductive housing structures 12W may run around the lip of housing 12 (i.e., peripheral conductive housing structures 12W may cover only the edge of housing 12 that surrounds display 14 and not the rest of the sidewalls of housing 12).

Rear housing wall 12R may lie in a plane that is parallel to display 14. In configurations for device 10 in which some or all of rear housing wall 12R is formed from metal, it may be desirable to form parts of peripheral conductive housing structures 12W as integral portions of the housing structures forming rear housing wall 12R. For example, rear housing wall 12R of device 10 may include a planar metal structure and portions of peripheral conductive housing structures 12W on the sides of housing 12 may be formed as flat or curved vertically extending integral metal portions of the planar metal structure (e.g., housing structures 12R and 12W may be formed from a continuous piece of metal in a unibody configuration). Housing structures such as these may, if desired, be machined from a block of metal and/or may include multiple metal pieces that are assembled together to form housing 12. Rear housing wall 12R may have one or more, two or more, or three or more portions. Peripheral conductive housing structures 12W and/or conductive portions of rear housing wall 12R may form one or more exterior surfaces of device 10 (e.g., surfaces that are visible to a user of device 10) and/or may be implemented using internal structures that do not form exterior surfaces of device 10 (e.g., conductive housing structures that are not visible to a user of device 10 such as conductive structures that are covered with layers such as thin cosmetic layers, protective coatings, and/or other coating/cover layers that may include dielectric materials such as glass, ceramic, plastic, or other structures that form the exterior surfaces of device 10 and/or serve to hide peripheral conductive housing structures 12W and/or conductive portions of rear housing wall 12R from view of the user).

Display 14 may have an array of pixels that form an active area AA that displays images for a user of device 10. For example, active area AA may include an array of display pixels. The array of pixels may be formed from liquid crystal display (LCD) components, an array of electrophoretic pixels, an array of plasma display pixels, an array of organic light-emitting diode display pixels or other light-emitting diode pixels, an array of electrowetting display pixels, or display pixels based on other display technologies. If desired, active area AA may include touch sensors such as touch sensor capacitive electrodes, force sensors, or other sensors for gathering a user input.

Display 14 may have an inactive border region that runs along one or more of the edges of active area AA. Inactive area IA of display 14 may be free of pixels for displaying images and may overlap circuitry and other internal device structures in housing 12. To block these structures from view by a user of device 10, the underside of the display cover layer or other layers in display 14 that overlap inactive area IA may be coated with an opaque masking layer in inactive area IA. The opaque masking layer may have any suitable color. Inactive area IA may include a recessed region or notch that extends into active area AA (e.g., at speaker port 16). Active area AA may, for example, be defined by the lateral area of a display module for display 14 (e.g., a display module that includes pixel circuitry, touch sensor circuitry, etc.).

Display 14 may be protected using a display cover layer such as a layer of transparent glass, clear plastic, transparent ceramic, sapphire, or other transparent crystalline material, or other transparent layer(s). The display cover layer may have a planar shape, a convex curved profile, a shape with planar and curved portions, a layout that includes a planar main area surrounded on one or more edges with a portion that is bent out of the plane of the planar main area, or other suitable shapes. The display cover layer may cover the entire front face of device 10. In another suitable arrangement, the display cover layer may cover substantially all of the front face of device 10 or only a portion of the front face of device 10. Openings may be formed in the display cover layer. For example, an opening may be formed in the display cover layer to accommodate a button. An opening may also be formed in the display cover layer to accommodate ports such as speaker port 16 or a microphone port. Openings may be formed in housing 12 to form communications ports (e.g., an audio jack port, a digital data port, etc.) and/or audio ports for audio components such as a speaker and/or a microphone if desired.

Display 14 may include conductive structures such as an array of capacitive electrodes for a touch sensor, conductive lines for addressing pixels, driver circuits, etc. Housing 12 may include internal conductive structures such as metal frame members and a planar conductive housing member (sometimes referred to as a conductive support plate or backplate) that spans the walls of housing 12 (e.g., a substantially rectangular sheet formed from one or more metal parts that is welded or otherwise connected between opposing sides of peripheral conductive housing structures 12W). The conductive support plate may form an exterior rear surface of device 10 or may be covered by a dielectric cover layer such as a thin cosmetic layer, protective coating, and/or other coatings that may include dielectric materials such as glass, ceramic, plastic, or other structures that form the exterior surfaces of device 10 and/or serve to hide the conductive support plate from view of the user (e.g., the conductive support plate may form part of rear housing wall 12R). Device 10 may also include conductive structures such as printed circuit boards, components mounted on printed circuit boards, and other internal conductive structures. These conductive structures, which may be used in forming a ground plane in device 10, may extend under active area AA of display 14, for example.

In regions 22 and 20, openings may be formed within the conductive structures of device 10 (e.g., between peripheral conductive housing structures 12W and opposing conductive ground structures such as conductive portions of rear housing wall 12R, conductive traces on a printed circuit board, conductive electrical components in display 14, etc.). These openings, which may sometimes be referred to as gaps, may be filled with air, plastic, and/or other dielectrics and may be used in forming slot antenna resonating elements for one or more antennas in device 10, if desired.

Conductive housing structures and other conductive structures in device 10 may serve as a ground plane for the antennas in device 10. The openings in regions 22 and 20 may serve as slots in open or closed slot antennas, may serve as a central dielectric region that is surrounded by a conductive path of materials in a loop antenna, may serve as a space that separates an antenna resonating element such as a strip antenna resonating element or an inverted-F antenna resonating element from the ground plane, may contribute to the performance of a parasitic antenna resonating element, or may otherwise serve as part of antenna structures formed in regions 22 and 20. If desired, the ground plane that is under active area AA of display 14 and/or other metal structures in device 10 may have portions that extend into parts of the ends of device 10 (e.g., the ground may extend towards the dielectric-filled openings in regions 22 and 20), thereby narrowing the slots in regions 22 and 20. Region 22 may sometimes be referred to herein as lower region 22 or lower end 22 of device 10. Region 20 may sometimes be referred to herein as upper region 20 or upper end 20 of device 10.

In general, device 10 may include any suitable number of antennas (e.g., one or more, two or more, three or more, four or more, etc.). The antennas in device 10 may be located at opposing first and second ends of an elongated device housing (e.g., at lower region 22 and/or upper region 20 of device 10 of FIG. 1), along one or more edges of a device housing, in the center of a device housing, in other suitable locations, or in one or more of these locations. The arrangement of FIG. 1 is merely illustrative.

Portions of peripheral conductive housing structures 12W may be provided with peripheral gap structures. For example, peripheral conductive housing structures 12W may be provided with one or more dielectric-filled gaps such as gaps 18, as shown in FIG. 1. The gaps in peripheral conductive housing structures 12W may be filled with dielectric such as polymer, ceramic, glass, air, other dielectric materials, or combinations of these materials. Gaps 18 may divide peripheral conductive housing structures 12W into one or more peripheral conductive segments. The conductive segments that are formed in this way may form parts of antennas in device 10 if desired. Other dielectric openings may be formed in peripheral conductive housing structures 12W (e.g., dielectric openings other than gaps 18) and may serve as dielectric antenna windows for antennas mounted within the interior of device 10. Antennas within device 10 may be aligned with the dielectric antenna windows for conveying radio-frequency signals through peripheral conductive housing structures 12W. Antennas within device 10 may also be aligned with inactive area IA of display 14 for conveying radio-frequency signals through display 14.

In order to provide an end user of device 10 with as large of a display as possible (e.g., to maximize an area of the device used for displaying media, running applications, etc.), it may be desirable to increase the amount of area at the front face of device 10 that is covered by active area AA of display 14. Increasing the size of active area AA may reduce the size of inactive area IA within device 10. This may reduce the area behind display 14 that is available for antennas within device 10. For example, active area AA of display 14 may include conductive structures that serve to block radio-frequency signals handled by antennas mounted behind active area AA from radiating through the front face of device 10. It would therefore be desirable to be able to provide antennas that occupy a small amount of space within device 10 (e.g., to allow for as large of a display active area AA as possible) while still allowing the antennas to communicate with wireless equipment external to device 10 with satisfactory efficiency bandwidth.

In a typical scenario, device 10 may have one or more upper antennas and one or more lower antennas. An upper antenna may, for example, be formed in upper region 20 of device 10. A lower antenna may, for example, be formed in lower region 22 of device 10. Additional antennas may be formed along the edges of housing 12 extending between regions 20 and 22 if desired. An example in which device 10 includes three or four upper antennas and five lower antennas is described herein as an example. The antennas may be used separately to cover identical communications bands, overlapping communications bands, or separate communications bands. The antennas may be used to implement an antenna diversity scheme or a multiple-input-multiple-output (MIMO) antenna scheme. Other antennas for covering any other desired frequencies may also be mounted at any desired locations within the interior of device 10. The example of FIG. 1 is merely illustrative. If desired, housing 12 may have other shapes (e.g., a square shape, cylindrical shape, spherical shape, combinations of these and/or different shapes, etc.).

Figure 2:
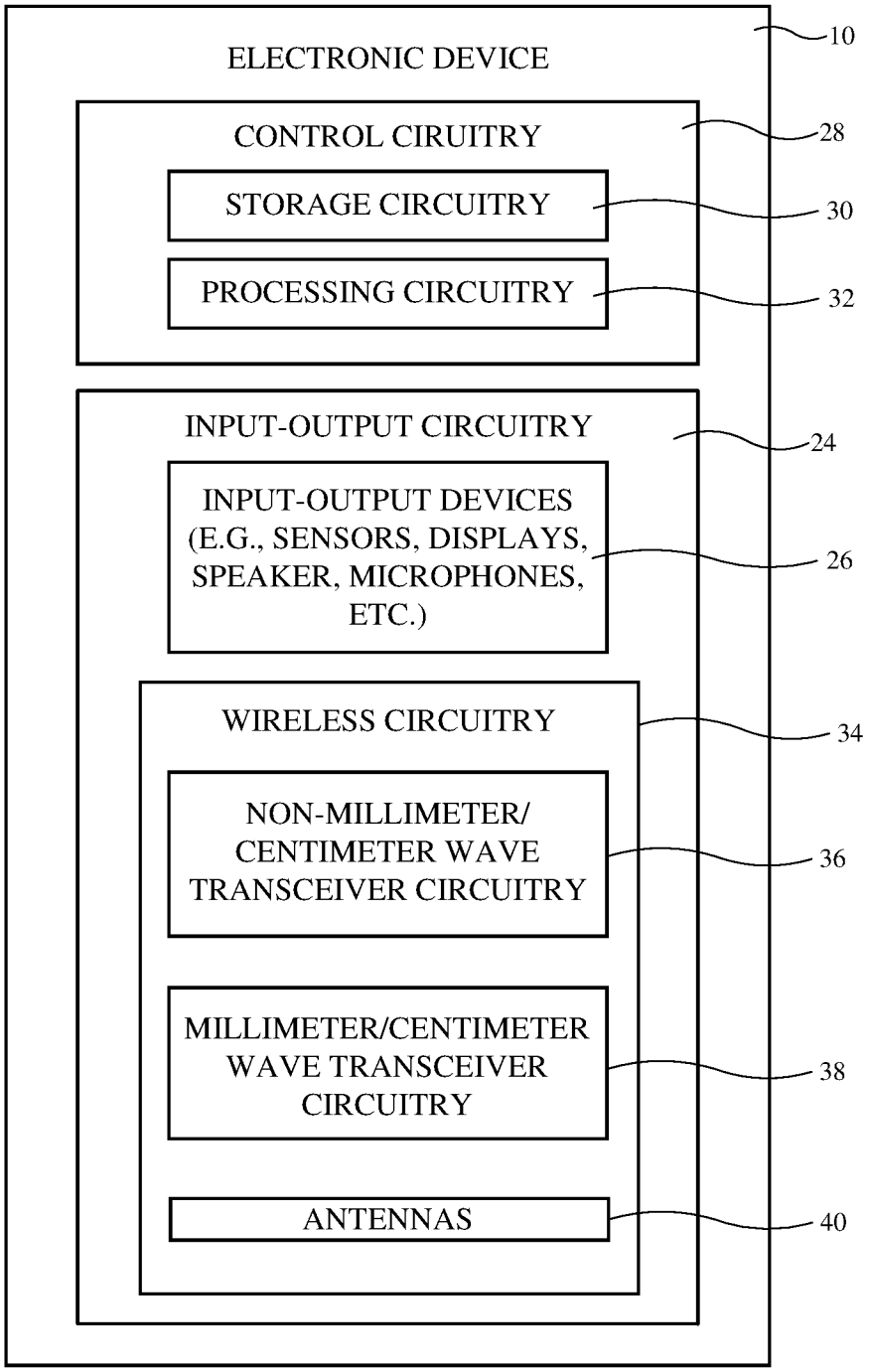
FIG. 2 is a schematic diagram of illustrative circuitry in an electronic device in accordance with some embodiments.

A schematic diagram of illustrative components that may be used in device 10 is shown in FIG. 2. As shown in FIG. 2, device 10 may include control circuitry 28. Control circuitry 28 may include storage such as storage circuitry 30. Storage circuitry 30 may include hard disk drive storage, nonvolatile memory (e.g., flash memory or other electrically-programmable-read-only memory configured to form a solid-state drive), volatile memory (e.g., static or dynamic random-access-memory), etc.

Control circuitry 28 may include processing circuitry such as processing circuitry 32. Processing circuitry 32 may be used to control the operation of device 10. Processing circuitry 32 may include on one or more microprocessors, microcontrollers, digital signal processors, host processors, baseband processor integrated circuits, application specific integrated circuits, central processing units (CPUs), etc. Control circuitry 28 may be configured to perform operations in device 10 using hardware (e.g., dedicated hardware or circuitry), firmware, and/or software. Software code for performing operations in device 10 may be stored on storage circuitry 30 (e.g., storage circuitry 30 may include non-transitory (tangible) computer readable storage media that stores the software code). The software code may sometimes be referred to as program instructions, software, data, instructions, or code. Software code stored on storage circuitry 30 may be executed by processing circuitry 32.

Control circuitry 28 may be used to run software on device 10 such as internet browsing applications, voice-over-internet-protocol (VOIP) telephone call applications, email applications, media playback applications, operating system functions, etc. To support interactions with external equipment, control circuitry 28 may be used in implementing communications protocols. Communications protocols that may be implemented using control circuitry 28 include internet protocols, wireless local area network protocols (e.g., IEEE 802.11 protocols—sometimes referred to as WiFi®), protocols for other short-range wireless communications links such as the Bluetooth® protocol or other WPAN protocols, IEEE 802.11ad protocols, cellular telephone protocols, MIMO protocols, antenna diversity protocols, satellite navigation system protocols, antenna-based spatial ranging protocols (e.g., radio detection and ranging (RADAR) protocols or other desired range detection protocols for signals conveyed at millimeter and centimeter wave frequencies), etc. Each communication protocol may be associated with a corresponding radio access technology (RAT) that specifies the physical connection methodology used in implementing the protocol.

Device 10 may include input-output circuitry 24. Input-output circuitry 24 may include input-output devices 26. Input-output devices 26 may be used to allow data to be supplied to device 10 and to allow data to be provided from device 10 to external devices. Input-output devices 26 may include user interface devices, data port devices, sensors, and other input-output components. For example, input-output devices may include touch screens, displays without touch sensor capabilities, buttons, joysticks, scrolling wheels, touch pads, key pads, keyboards, microphones, cameras, speakers, status indicators, light sources, audio jacks and other audio port components, digital data port devices, light sensors, gyroscopes, accelerometers or other components that can detect motion and device orientation relative to the Earth, capacitance sensors, proximity sensors (e.g., a capacitive proximity sensor and/or an infrared proximity sensor), magnetic sensors, and other sensors and input-output components.

Input-output circuitry 24 may include wireless circuitry such as wireless circuitry 34 for wirelessly conveying radio-frequency signals. While control circuitry 28 is shown separately from wireless circuitry 34 in the example of FIG. 2 for the sake of clarity, wireless circuitry 34 may include processing circuitry that forms a part of processing circuitry 32 and/or storage circuitry that forms a part of storage circuitry 30 of control circuitry 28 (e.g., portions of control circuitry 28 may be implemented on wireless circuitry 34). As an example, control circuitry 28 may include baseband processor circuitry or other control components that form a part of wireless circuitry 34.

Wireless circuitry 34 may include millimeter and centimeter wave transceiver circuitry such as millimeter/centimeter wave transceiver circuitry 38. Millimeter/centimeter wave transceiver circuitry 38 may support communications at frequencies between about 10 GHz and 300 GHz. For example, millimeter/centimeter wave transceiver circuitry 38 may support communications in Extremely High Frequency (EHF) or millimeter wave communications bands between about 30 GHz and 300 GHz and/or in centimeter wave communications bands between about 10 GHz and 30 GHz (sometimes referred to as Super High Frequency (SHF) bands). As examples, millimeter/centimeter wave transceiver circuitry 38 may support communications in an IEEE K communications band between about 18 GHz and 27 GHz, a $K_a$ communications band between about 26.5 GHz and 40 GHz, a $K_u$ communications band between about 12 GHz and 18 GHz, a V communications band between about 40 GHz and 75 GHz, a W communications band between about 75 GHz and 110 GHz, or any other desired frequency band between approximately 10 GHz and 300 GHz. If desired, millimeter/centimeter wave transceiver circuitry 38 may support IEEE 802.11ad communications at 60 GHz (e.g., WiGig or 60 GHz Wi-Fi bands around 57-61 GHz), and/or $5^{th}$ generation mobile networks or $5^{th}$ generation wireless systems (5G) New Radio (NR) Frequency Range 2 (FR2) communications bands between about 24 GHz and 90 GHz. Millimeter/centimeter wave transceiver circuitry 38 may be formed from one or more integrated circuits (e.g., multiple integrated circuits mounted on a common printed circuit in a system-in-package device, one or more integrated circuits mounted on different substrates, etc.).

Millimeter/centimeter wave transceiver circuitry 38 (sometimes referred to herein simply as transceiver circuitry 38 or millimeter/centimeter wave circuitry 38) may perform spatial ranging operations using radio-frequency signals at millimeter and/or centimeter wave frequencies that are transmitted and received by millimeter/centimeter wave transceiver circuitry 38. The received signals may be a version of the transmitted signals that have been reflected off of external objects and back towards device 10. Control circuitry 28 may process the transmitted and received signals to detect or estimate a range between device 10 and one or more external objects in the surroundings of device 10 (e.g., objects external to device 10 such as the body of a user or other persons, other devices, animals, furniture, walls, or other objects or obstacles in the vicinity of device 10). If desired, control circuitry 28 may also process the transmitted and received signals to identify a two or three-dimensional spatial location of the external objects relative to device 10.

Spatial ranging operations performed by millimeter/centimeter wave transceiver circuitry 38 are unidirectional. If desired, millimeter/centimeter wave transceiver circuitry 38 may also perform bidirectional communications with external wireless equipment such as external wireless equipment 10 (e.g., over a bi-directional millimeter/centimeter wave wireless communications link). The external wireless equipment may include other electronic devices such as electronic device 10, a wireless base station, wireless access point, a wireless accessory, or any other desired equipment that transmits and receives millimeter/centimeter wave signals. Bidirectional communications involve both the transmission of wireless data by millimeter/centimeter wave transceiver circuitry 38 and the reception of wireless data that has been transmitted by external wireless equipment. The wireless data may, for example, include data that has been encoded into corresponding data packets such as wireless data associated with a telephone call, streaming media content, internet browsing, wireless data associated with software applications running on device 10, email messages, etc.

If desired, wireless circuitry 34 may include transceiver circuitry for handling communications at frequencies below 10 GHz such as non-millimeter/centimeter wave transceiver circuitry 36. For example, non-millimeter/centimeter wave transceiver circuitry 36 may handle wireless local area network (WLAN) communications bands such as the 2.4 GHz and 5 GHz Wi-Fi® (IEEE 802.11) bands, wireless personal area network (WPAN) communications bands such as the 2.4 GHz Bluetooth® communications band, cellular telephone communications bands such as a cellular low band (LB) (e.g., 600 to 960 MHz), a cellular low-midband (LMB) (e.g., 1400 to 1550 MHz), a cellular midband (MB) (e.g., from 1700 to 2200 MHz), a cellular high band (HB) (e.g., from 2300 to 2700 MHz), a cellular ultra-high band (UHB) (e.g., from 3300 to 5000 MHz, or other cellular communications bands between about 600 MHz and about 5000 MHz (e.g., 3G bands, 4G LTE bands, 5G New Radio Frequency Range 1 (FR1) bands below 10 GHz, etc.), a near-field communications (NFC) band (e.g., at 13.56 MHz), satellite navigations bands (e.g., an L1 global positioning system (GPS) band at 1575 MHz, an L5 GPS band at 1176 MHz, a Global Navigation Satellite System (GLONASS) band, a BeiDou Navigation Satellite System (BDS) band, etc.), ultra-wideband (UWB) communications band(s) supported by the IEEE 802.15.4 protocol and/or other UWB communications protocols (e.g., a first UWB communications band at 6.5 GHz and/or a second UWB communications band at 8.0 GHz), and/or any other desired communications bands. The communications bands handled by the radio-frequency transceiver circuitry may sometimes be referred to herein as frequency bands or simply as "bands," and may span corresponding ranges of frequencies. Non-millimeter/centimeter wave transceiver circuitry 36 and millimeter/centimeter wave transceiver circuitry 38 may each include one or more integrated circuits, power amplifier circuitry, low-noise input amplifiers, passive radio-frequency components, switching circuitry, transmission line structures, and other circuitry for handling radio-frequency signals.

In general, the transceiver circuitry in wireless circuitry 34 may cover (handle) any desired frequency bands of interest. As shown in FIG. 2, wireless circuitry 34 may include antennas 40. The transceiver circuitry may convey radio-frequency signals using one or more antennas 40 (e.g., antennas 40 may convey the radio-frequency signals for the transceiver circuitry). The term "convey radio-frequency signals" as used herein means the transmission and/or reception of the radio-frequency signals (e.g., for performing unidirectional and/or bidirectional wireless communications with external wireless communications equipment). Antennas 40 may transmit the radio-frequency signals by radiating the radio-frequency signals into free space (or to freespace through intervening device structures such as a dielectric cover layer). Antennas 40 may additionally or alternatively receive the radio-frequency signals from free space (e.g., through intervening devices structures such as a dielectric cover layer). The transmission and reception of radio-frequency signals by antennas 40 each involve the excitation or resonance of antenna currents on an antenna resonating element in the antenna by the radio-frequency signals within the frequency band(s) of operation of the antenna.

In satellite navigation system links, cellular telephone links, and other long-range links, radio-frequency signals are typically used to convey data over thousands of feet or miles. In Wi-Fi® and Bluetooth® links at 2.4 and 5 GHz and other short-range wireless links, radio-frequency signals are typically used to convey data over tens or hundreds of feet. Millimeter/centimeter wave transceiver circuitry 38 may convey radio-frequency signals over short distances that travel over a line-of-sight path. To enhance signal reception for millimeter and centimeter wave communications, phased antenna arrays and beam forming (steering) techniques may be used (e.g., schemes in which antenna signal phase and/or magnitude for each antenna in an array are adjusted to perform beam steering). Antenna diversity schemes may also be used to ensure that the antennas that have become blocked or that are otherwise degraded due to the operating environment of device 10 can be switched out of use and higher-performing antennas used in their place.

Antennas 40 in wireless circuitry 34 may be formed using any suitable antenna types. For example, antennas 40 may include antennas with resonating elements that are formed from stacked patch antenna structures, loop antenna structures, patch antenna structures, inverted-F antenna structures, slot antenna structures, planar inverted-F antenna structures, monopole antenna structures, dipole antenna structures, helical antenna structures, Yagi (Yagi-Uda) antenna structures, hybrids of these designs, etc. If desired, one or more of antennas 40 may be cavity-backed antennas. Different types of antennas may be used for different bands and combinations of bands. For example, one type of antenna may be used in forming a non-millimeter/centimeter wave wireless link for non-millimeter/centimeter wave transceiver circuitry 36 and another type of antenna may be used in conveying radio-frequency signals at millimeter and/or centimeter wave frequencies for millimeter/centimeter wave transceiver circuitry 38. Antennas 40 that are used to convey radio-frequency signals at millimeter and centimeter wave frequencies may be arranged in one or more phased antenna arrays. In one suitable arrangement that is described herein as an example, the antennas 40 that are arranged in a corresponding phased antenna array may be stacked patch antennas having patch antenna resonating elements that overlap and are vertically stacked with respect to one or more parasitic patch elements.

Figure 3:
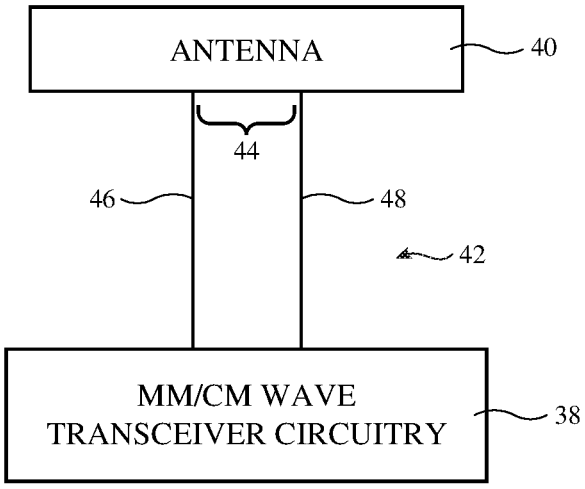
FIG. 3 is a schematic diagram of illustrative wireless circuitry in accordance with some embodiments.

FIG. 3 is a diagram showing how a given antenna 40 may be fed by a corresponding radio-frequency transmission line path. As shown in FIG. 3, millimeter/centimeter wave transceiver circuitry 38 may be coupled to a given antenna 40 using a radio-frequency transmission line path such as radio-frequency transmission line path 42.

To provide antenna structures such as antenna 40 with the ability to cover different frequencies of interest, antenna 40 may be provided with circuitry such as filter circuitry (e.g., one or more passive filters and/or one or more tunable filter circuits). Discrete components such as capacitors, inductors, and resistors may be incorporated into the filter circuitry. Capacitive structures, inductive structures, and resistive structures may also be formed from patterned metal structures (e.g., part of an antenna). If desired, antenna 40 may be provided with adjustable circuits such as tunable components that tune the antenna over communications (frequency) bands of interest. The tunable components may be part of a tunable filter or tunable impedance matching network, may be part of an antenna resonating element, may span a gap between an antenna resonating element and antenna ground, etc.

Radio-frequency transmission line path 42 may include one or more radio-frequency transmission lines (sometimes referred to herein simply as transmission lines). Radio-frequency transmission line path 42 (e.g., the transmission lines in radio-frequency transmission line path 42) may include a positive signal conductor such as positive signal conductor 46 and a ground signal conductor such as ground conductor 48.

The transmission lines in radio-frequency transmission line path 42 may, for example, include coaxial cable transmission lines (e.g., ground conductor 48 may be implemented as a grounded conductive braid surrounding signal conductor 46 along its length), stripline transmission lines (e.g., where ground conductor 48 extends along two sides of signal conductor 46), a microstrip transmission line (e.g., where ground conductor 48 extends along one side of signal conductor 46), coaxial probes realized by a metalized via, edge-coupled microstrip transmission lines, edge-coupled stripline transmission lines, waveguide structures (e.g., coplanar waveguides or grounded coplanar waveguides), combinations of these types of transmission lines and/or other transmission line structures, etc.

Transmission lines in radio-frequency transmission line path 42 may be integrated into rigid and/or flexible printed circuit boards. In one suitable arrangement, radio-frequency transmission line path 42 may include transmission line conductors (e.g., signal conductors 46 and ground conductors 48) integrated within multilayer laminated structures (e.g., layers of a conductive material such as copper and a dielectric material such as a resin that are laminated together without intervening adhesive). The multilayer laminated structures may, if desired, be folded or bent in multiple dimensions (e.g., two or three dimensions) and may maintain a bent or folded shape after bending (e.g., the multilayer laminated structures may be folded into a particular three-dimensional shape to route around other device components and may be rigid enough to hold its shape after folding without being held in place by stiffeners or other structures). All of the multiple layers of the laminated structures may be batch laminated together (e.g., in a single pressing process) without adhesive (e.g., as opposed to performing multiple pressing processes to laminate multiple layers together with adhesive).

A matching network may include components such as inductors, resistors, and capacitors used in matching the impedance of antenna 40 to the impedance of radio-frequency transmission line path 42. Matching network components may be provided as discrete components (e.g., surface mount technology components) or may be formed from housing structures, printed circuit board structures, traces on plastic supports, etc. Components such as these may also be used in forming filter circuitry in antenna(s) 40 and may be tunable and/or fixed components.

Radio-frequency transmission line path 42 may be coupled to antenna feed structures associated with antenna 40. As examples, antenna 40 may form an inverted-F antenna, a planar inverted-F antenna, a patch antenna, a stacked patch antenna, a dipole antenna, a helical antenna, a monopole antenna, or another type of antenna having an antenna feed 44. Antenna feed 44 may have a positive antenna feed terminal and a ground antenna feed terminal. The positive antenna feed terminal may be coupled to an antenna resonating element for antenna 40. The ground antenna feed terminal may be coupled to an antenna ground for antenna 40. Signal conductor 46 may be coupled to the positive antenna feed terminal and ground conductor 48 may be coupled to the ground antenna feed terminal. Other types of antenna feed arrangements may be used if desired. The illustrative feeding configuration of FIG. 3 is merely illustrative.

Figure 4:
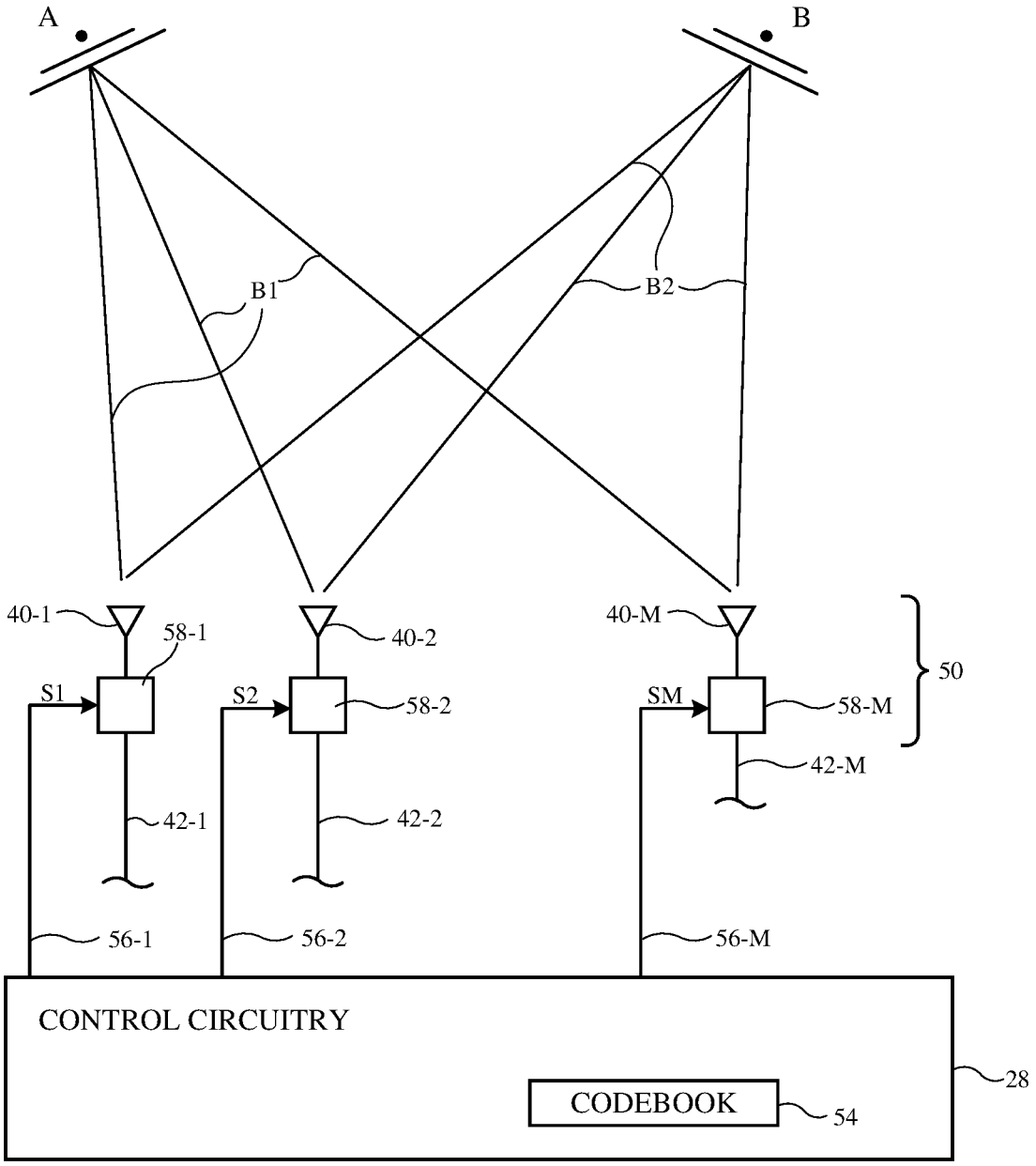
FIG. 4 is a diagram of an illustrative phased antenna array that may be controlled using a codebook to form a radio-frequency signal beam at different beam pointing angles in accordance with some embodiments.

Antennas 40 that are used to convey radio-frequency signals at millimeter and centimeter wave frequencies may be arranged in one or more phased antenna arrays. FIG. 4 is a diagram showing how antennas 40 for handling radio-frequency signals at millimeter and centimeter wave frequencies may be formed in a phased antenna array. As shown in FIG. 4, phased antenna array 50 (sometimes referred to herein as array 50, antenna array 50, or array 50 of antennas 40) may be coupled to radio-frequency transmission line paths 42. For example, a first antenna 40-1 in phased antenna array 50 may be coupled to a first radio-frequency transmission line path 42-1, a second antenna 40-2 in phased antenna array 50 may be coupled to a second radio-frequency transmission line path 42-2, an Mth antenna 40-M in phased antenna array 50 may be coupled to an Mth radio-frequency transmission line path 42-M, etc. While antennas 40 are described herein as forming a phased antenna array, the antennas 40 in phased antenna array 50 may sometimes also be referred to as collectively forming a single phased array antenna (e.g., where each antenna 40 in the phased array antenna forms an antenna element of the phased array antenna). Radio-frequency transmission line paths 42 may each be coupled to millimeter/centimeter wave transceiver circuitry 38 of FIG. 3.

The antennas 40 in phased antenna array 50 may be arranged in any desired number of rows and columns or in any other desired pattern (e.g., the antennas need not be arranged in a grid pattern having rows and columns). During signal transmission operations, radio-frequency transmission line paths 42 may be used to supply signals (e.g., radio-frequency signals such as millimeter wave and/or centimeter wave signals) from millimeter/centimeter wave transceiver circuitry 38 (FIG. 3) to phased antenna array 50 for wireless transmission. During signal reception operations, radio-frequency transmission line paths 42 may be used to convey signals received at phased antenna array 50 to millimeter/centimeter wave transceiver circuitry 38 (FIG. 3).

The use of multiple antennas 40 in phased antenna array 50 allows radio-frequency beam forming arrangements (sometimes referred to herein as radio-frequency beam steering arrangements) to be implemented by controlling the relative phases and magnitudes (amplitudes) of the radio-frequency signals conveyed by the antennas. In the example of FIG. 4, the antennas 40 in phased antenna array 50 each have a corresponding radio-frequency phase and magnitude controller 58 (e.g., a first phase and magnitude controller 58-1 interposed on radio-frequency transmission line path 42-1 may control phase and magnitude for radio-frequency signals handled by antenna 40-1, a second phase and magnitude controller 58-2 interposed on radio-frequency transmission line path 42-2 may control phase and magnitude for radio-frequency signals handled by antenna 40-2, an Mth phase and magnitude controller 58-M interposed on radio-frequency transmission line path 42-M may control phase and magnitude for radio-frequency signals handled by antenna 40-M, etc.).

Phase and magnitude controllers 58 may each include circuitry for adjusting the phase of the radio-frequency signals on radio-frequency transmission line paths 42 (e.g., phase shifter circuits) and/or circuitry for adjusting the magnitude of the radio-frequency signals on radio-frequency transmission line paths 42 (e.g., power amplifier and/or low noise amplifier circuits). Phase and magnitude controllers 58 may sometimes be referred to collectively herein as beam steering or beam forming circuitry (e.g., beam steering circuitry that steers the beam of radio-frequency signals transmitted and/or received by phased antenna array 50).

Phase and magnitude controllers 58 may adjust the relative phases and/or magnitudes of the transmitted signals that are provided to each of the antennas in phased antenna array 50 and may adjust the relative phases and/or magnitudes of the received signals that are received by phased antenna array 50. Phase and magnitude controllers 58 may, if desired, include phase detection circuitry for detecting the phases of the received signals that are received by phased antenna array 50. The term "beam," "signal beam," "radio-frequency beam," or "radio-frequency signal beam" may be used herein to collectively refer to wireless signals that are transmitted and received by phased antenna array 50 in a particular direction. The signal beam may exhibit a peak gain that is oriented in a particular beam pointing direction at a corresponding beam pointing angle (e.g., based on constructive and destructive interference from the combination of signals from each antenna in the phased antenna array). The term "transmit beam" may sometimes be used herein to refer to radio-frequency signals that are transmitted in a particular direction whereas the term "receive beam" may sometimes be used herein to refer to radio-frequency signals that are received from a particular direction.

If, for example, phase and magnitude controllers 58 are adjusted to produce a first set of phases and/or magnitudes for transmitted radio-frequency signals, the transmitted signals will form a transmit beam as shown by beam B1 of FIG. 4 that is oriented in the direction of point A. If, however, phase and magnitude controllers 58 are adjusted to produce a second set of phases and/or magnitudes for the transmitted signals, the transmitted signals will form a transmit beam as shown by beam B2 that is oriented in the direction of point B. Similarly, if phase and magnitude controllers 58 are adjusted to produce the first set of phases and/or magnitudes, radio-frequency signals (e.g., radio-frequency signals in a receive beam) may be received from the direction of point A, as shown by beam B1. If phase and magnitude controllers 58 are adjusted to produce the second set of phases and/or magnitudes, radio-frequency signals may be received from the direction of point B, as shown by beam B2.

Each phase and magnitude controller 58 may be controlled to produce a desired phase and/or magnitude based on a corresponding control signal S received from control circuitry 28 over control paths 56 (e.g., the phase and/or magnitude provided by phase and magnitude controller 58-1 may be controlled using control signal S1 on control path 56-1, the phase and/or magnitude provided by phase and magnitude controller 58-2 may be controlled using control signal S2 on control path 56-2, the phase and/or magnitude provided by phase and magnitude controller 58-M may be controlled using control signal SM on control path 56-M, etc.). If desired, control circuitry 28 may actively adjust control signals S in real time to steer the transmit or receive beam in different desired directions (e.g., to different desired beam pointing angles) over time. Phase and magnitude controllers 58 may provide information identifying the phase of received signals to control circuitry 28 if desired.

When performing wireless communications using radio-frequency signals at millimeter and centimeter wave frequencies, the radio-frequency signals are conveyed over a line of sight path between phased antenna array 50 and external wireless equipment. If the external wireless equipment is located at point A of FIG. 4, phase and magnitude controllers 58 may be adjusted to steer the signal beam towards point A (e.g., to form a signal beam having a beam pointing angle directed towards point A). Phased antenna array 50 may then transmit and receive radio-frequency signals in the direction of point A. Similarly, if the external wireless equipment is located at point B, phase and magnitude controllers 58 may be adjusted to steer the signal beam towards point B (e.g., to form a signal beam having a beam pointing angle directed towards point B). Phased antenna array 50 may then transmit and receive radio-frequency signals in the direction of point B. In the example of FIG. 4, beam steering is shown as being performed over a single degree of freedom for the sake of simplicity (e.g., towards the left and right on the page of FIG. 4). However, in practice, the beam may be steered over two or more degrees of freedom (e.g., in three dimensions, into and out of the page and to the left and right on the page of FIG. 4). Phased antenna array 50 may have a corresponding field of view over which beam steering can be performed (e.g., in a hemisphere or a segment of a hemisphere over the phased antenna array). If desired, device 10 may include multiple phased antenna arrays that each face a different direction to provide coverage from multiple sides of the device.

Control circuitry 28 may identify a desired beam pointing angle for the signal beam of phased antenna array 50 and may adjust the control signals S provided to phased antenna array 50 to configure phased antenna array 50 to form (steer) the signal beam at that beam pointing angle. Each possible beam pointing angle that can be used by phased antenna array 50 during wireless communications may be identified by a beam steering codebook such as codebook 54. Codebook 54 may be stored at control circuitry 28, elsewhere on device 10, or may be located (offloaded) on external equipment and conveyed to device 10 over a wired or wireless communications link.

Codebook 54 may identify each possible beam pointing angle that may be used by phased antenna array 50. Control circuitry 28 may store or identify phase and magnitude settings for phase and magnitude controllers 58 to use in implementing each of those beam pointing angles (e.g., control circuitry 28 or codebook 54 may include information that maps each beam pointing angle for phased antenna array 50 to a corresponding set of phase and magnitude values for phase and magnitude controllers 58). Codebook 54 may be hard-coded or soft-coded into control circuitry 28 or elsewhere in device 10, may include one or more databases stored at control circuitry 28 or elsewhere in device 10 (e.g., codebook 54 may be stored as software code), may include one or more look-up-tables at control circuitry 28 or elsewhere in device 10, and/or may include any other desired data structures stored in hardware and/or software on device 10. In one suitable arrangement that is described herein as an example, codebook 54 may include a beam table that identifies each beam pointing angle formable using phased antenna array 50 and the corresponding phase and magnitude settings for each phase and magnitude controller 58 to form beams at those beam pointing angles. Codebook 54 may be generated during calibration of device 10 (e.g., during design, manufacturing, and/or testing of device 10 prior to device 10 being received by an end user) and/or may be dynamically updated over time (e.g., after device 10 has been used by an end user).

Control circuitry 28 may generate control signals S based on codebook 54. For example, control circuitry 28 may identify a beam pointing angle that would be needed to communicate with external wireless equipment (e.g., a beam pointing angle pointing towards the external wireless equipment). Control circuitry 28 may subsequently identify the beam pointing angle in codebook 54 that is closest to this identified beam pointing angle. Control circuitry 28 may use codebook 54 to generate phase and magnitude values for phase and magnitude controllers 58. Control circuitry 28 may transmit control signals S identifying these phase and magnitude values to phase and magnitude controllers 58 over control paths 56. The beam formed by phased antenna array 50 using control signals S will be oriented at the beam pointing angle identified by codebook 54. Control circuitry 28 may perform beam sweeping operations to identify a beam pointing angle to use. In performing beam sweeping operations, control circuitry 28 may sweep over some or all of the different beam pointing angles identified by codebook 54 until the external wireless equipment is found and may use the corresponding beam pointing angle at which the external wireless equipment was found to communicate with the external wireless equipment.

If desired, device 10 may include multiple phased antenna arrays 50. Mounting different phased antenna arrays 50 at different locations on device 10 may allow each phased antenna array to collectively provide millimeter/centimeter wave coverage across an entire sphere around device 10. If desired, device 10 may include multiple phased antenna arrays that point in the same direction. For example, device 10 may include a first phased antenna array and a second phased antenna array that both radiate through a given housing wall of device 10. In one suitable arrangement that is described herein as an example, device 10 may include first and second phased antenna arrays 50 that both radiate through rear housing wall 12R of device 10 (FIG. 1).

Figure 5:
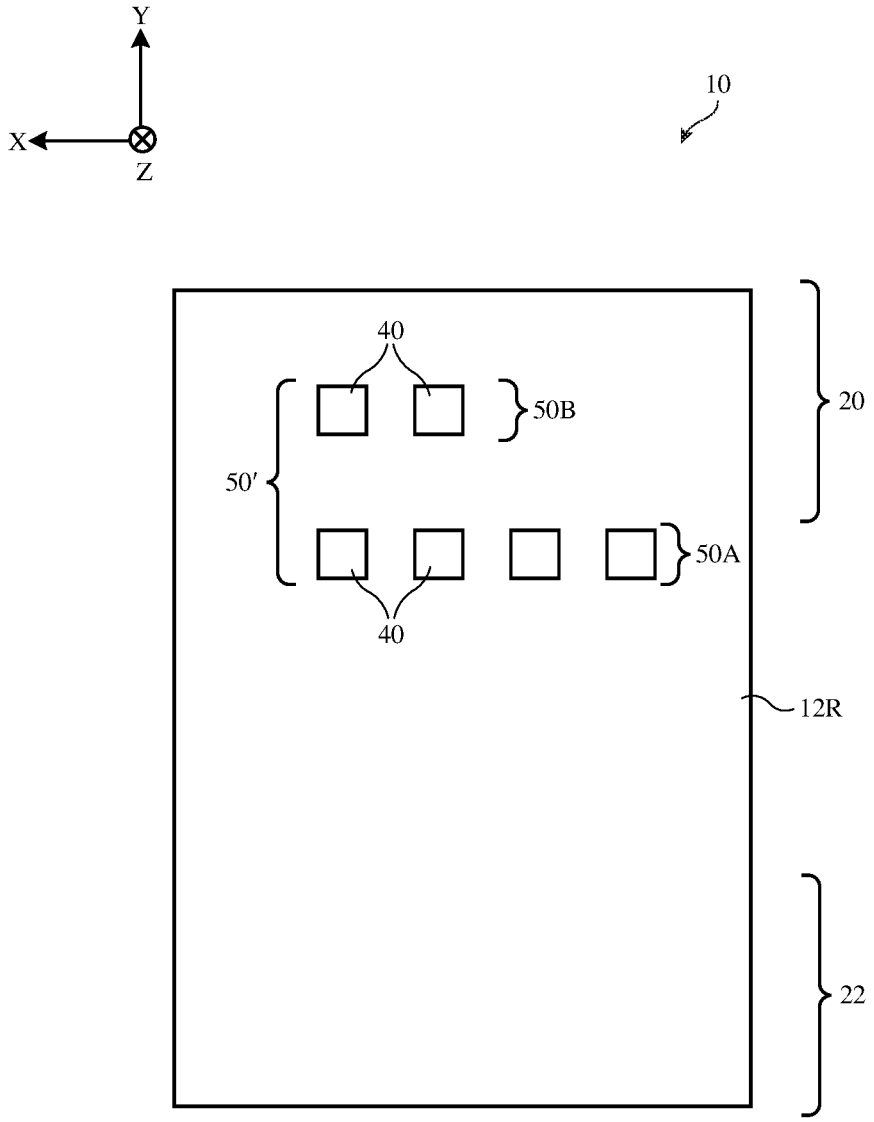
FIG. 5 is a rear view of an illustrative electronic device having a primary phased antenna array and a secondary phased antenna array in accordance with some embodiments.

FIG. 5 is a rear view showing how device 10 may include first and second phased antenna arrays 50 that both radiate through rear housing wall 12R of device 10. As shown in FIG. 5, device 10 may include a first phased antenna array 50A and a second phased antenna array 50B. Phased antenna arrays 50A and 50B may both be aligned with rear housing wall 12R for radiating through rear housing wall 12R (e.g., for radiating through one or more dielectric windows in a conductive support plate in rear housing wall 12R, for radiating through a dielectric cover layer in rear housing wall 12R, etc.). Phased antenna arrays 50A and 50B may therefore provide millimeter/centimeter wave coverage across some or all of the hemisphere under the rear face of device 10. Phased antenna arrays 50A and 50B may both lie within upper region 20 of device 10, within lower region 22 of device 10, or may be distributed across different regions of device 10 (e.g., where phased antenna array 50B is located within upper region 20 whereas phased antenna array 50A is located outside of upper region 20, etc.). This example is merely illustrative and, in general, phased antenna arrays 50A and 50B may radiate through any desired wall of device 10.

In one suitable arrangement that is described herein as an example, phased antenna array 50A includes more antennas 40 than phased antenna array 50B. This may configure phased antenna array 50A to support greater peak gain and greater signal beam resolution than phased antenna array 50B. Phased antenna array 50A may therefore sometimes be referred to herein as primary phased antenna array (PAA) 50A whereas phased antenna array 50B is sometimes referred to herein as secondary phased antenna array (PAA) 50B.

In the example of FIG. 5, primary PAA 50A is a one-dimensional phased antenna array having four antennas 40 arranged in a single row and secondary PAA 50B is a one-dimensional phased antenna array having two antennas 40 arranged in a single row. This is merely illustrative. In general, primary PAA 50A may include any desired number of antennas 40 arranged in any desired number of rows and columns or in any other desired pattern overlapping rear housing wall 12R. Similarly, secondary PAA 50B may include any desired number of antennas 40 arranged in any desired number of rows and columns or in any other desired pattern overlapping rear housing wall 12R (e.g., where the number of antennas 40 in secondary PAA 50B is less than the number of antennas 40 in primary PAA 50A).

If desired, primary PAA 50A and secondary PAA 50B may be operated in a diversity mode in which only primary PAA 50A is used to convey radio-frequency signals until the wireless performance of primary PAA 50A drops below a predetermined threshold level (e.g., due to an external object such as hand, tabletop, or other object blocking primary PAA 50A). When this occurs, primary PAA 50A may be switched out of use and secondary PAA 50B may instead be used to convey radio-frequency signals until primary PAA 50A is no longer blocked (or until primary PAA 50A once again exhibits wireless performance greater than the predetermined threshold level). Because secondary PAA 50B has fewer antennas 40 than primary PAA 50A, secondary PAA 50B may occupy less space within device 10. Secondary PAA 50B may therefore have increased placement flexibility within device 10 (e.g., while allowing space for other components in device 10). In this way, primary PAA 50A (e.g., the PAA having greater peak gain and signal beam resolution) may be used most of the time until the primary PAA 50A no longer exhibits satisfactory wireless performance, in which case secondary PAA 50B may be used temporarily until primary PAA 50A once again exhibits satisfactory wireless performance.

In the diversity mode, primary PAA 50A and secondary PAA 50B are each independently steerable (e.g., primary PAA 50A and secondary PAA 50B may each be controlled by different phase and magnitude controllers 58 of FIG. 4). Secondary PAA 50B may be separated from primary PAA 50A by a distance (e.g., measured parallel to the Y-axis) that is greater than one-half of the effective wavelengths of operation of phased antenna arrays 50A and 50B (e.g., where the effective wavelength is equal to a free space wavelength multiplied by a constant value based on the dielectric material surrounding the antennas). At the same time, each antenna 40 in primary PAA 50A may be separated from one or more adjacent antennas 40 in primary PAA 50A by a distance approximately equal to one-half of the effective wavelength of operation of primary PAA 50A. Similarly, each antenna 40 in secondary PAA 50B may be separated from one or more adjacent antennas 40 in secondary PAA 50B by a distance approximately equal to one-half of the effective wavelength of operation of secondary PAA 50B. The antennas 40 in primary PAA 50A may produce a signal beam in a desired beam pointing direction (e.g., as identified by codebook 54 of FIG. 4). When secondary PAA 50B is in use, the antennas 40 in secondary PAA 50B may produce a signal beam in a desired beam pointing direction. In other words, primary PAA 50A and secondary PAA 50B may be separate, independently controllable phased antenna arrays in device 10.

In one suitable arrangement that is described herein as an example, primary PAA 50A and secondary PAAB may also be operable in a simultaneous array mode of operation. In the simultaneous mode of operation, the antennas 40 in primary PAA 50A and the antennas 40 in secondary PAA 50B may be simultaneously active. In the simultaneous mode of operation, primary PAA 50A and secondary PAA 50B may be controlled as a single combined phased antenna array (PAA) 50'. Combined PAA 50' may produce a single signal beam (e.g., with signal contributions from each of the antennas 40 in both primary PAA 50A and secondary PAA 50B) oriented in a corresponding beam pointing direction (e.g., as identified by codebook 54 of FIG. 4). Because combined PAA 50' has more total antennas than primary PAA 50A (e.g., six antennas 40 as shown in FIG. 5), combined PAA 50' may exhibit greater peak gain and higher beam resolution than primary PAA 50A.

Figure 6:
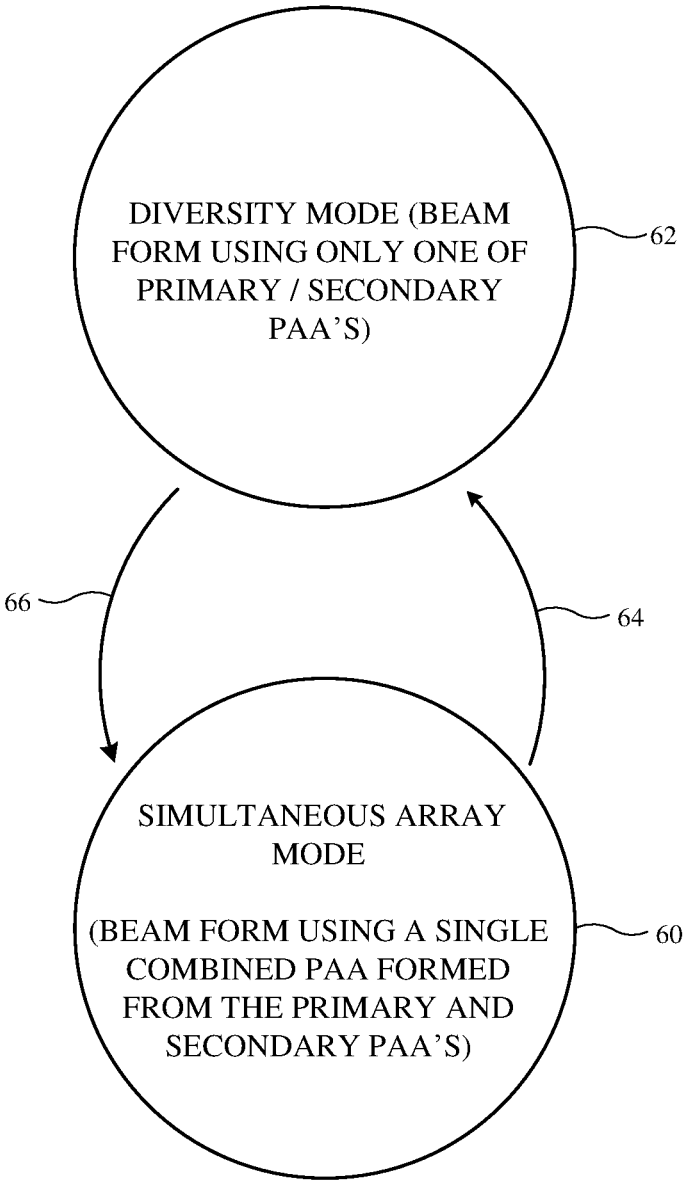
FIG. 6 is a state diagram of illustrative operating modes for an electronic device having primary and secondary phased antenna arrays in accordance with some embodiments.

FIG. 6 is a state diagram of illustrative operating modes for wireless circuitry 34 and device 10. As shown in FIG. 6, the wireless circuitry may be operable in a first mode (state) such as diversity mode 62 and in a second mode (state) such as simultaneous array mode 60.

In diversity mode 62, only one of primary PAA 50A or secondary PAA 50B is active at a given time. For example, primary PAA 50A may convey radio-frequency signals over a corresponding signal beam unless primary PAA 50A is being blocked by an external object or otherwise exhibits unsatisfactory wireless performance. If primary PAA 50A is being blocked by an external object or exhibits unsatisfactory wireless performance, secondary PAA 50B may convey radio-frequency signals over a corresponding signal beam.

Control circuitry 28 (FIG. 4) may gather wireless performance metric data and/or sensor data to determine whether primary PAA 50A or secondary PAA 50B is active in diversity mode 62. The wireless performance metric information may include error rate data, signal-to-noise-ratio data, noise data, received power level data, or any other desired radio-frequency performance metric information. The sensor data may include impedance sensor data, phase and magnitude sensor data, proximity sensor data, ambient light sensor data, image sensor data, orientation sensor data, temperature sensor data, or any other desired sensor data. Control circuitry 28 may switch between primary PAA 50A and secondary PAA 50B over time to ensure that the optimal PAA is used at any given time (e.g., to allow continuous and uninterrupted wireless communications with external communications equipment even if external objects temporarily block one of the arrays).

In simultaneous array mode 60, control circuitry 28 may form a signal beam using a combination of the antennas 40 in both primary PAA 50A and secondary PAA 50B (e.g., control circuitry 28 may convey radio-frequency signals using combined PAA 50' of FIG. 5). The signal beam produced by combined PAA 50' may have greater peak gain and greater beam resolution than either primary PAA 50A or secondary PAA 50B.

Control circuitry 28 may transition the wireless circuitry from diversity mode 62 to simultaneous array mode 60, as shown by arrow 64, in response to any desired trigger condition. The trigger condition may occur, for example, when neither primary PAA 50A nor secondary PAA 50B exhibits satisfactory wireless performance or when combined PAA 50' exhibits greater wireless performance than either primary PAA 50A or secondary PAA 50B (e.g., wireless performance that exceeds the wireless performance of either primary PAA 50A or secondary PAA 50B by a predetermined margin). The trigger condition may also occur when there is a corresponding application call by an application running on device 10, when the gathered wireless performance metric data and/or sensor data exhibits a predetermined value, when a user provides a user input instructing device 10 to switch operating modes, etc.

Similarly, control circuitry 28 may transition the wireless circuitry from simultaneous array mode 60 to diversity mode 62, as shown by arrow 66, in response to any desired trigger condition. The trigger condition may occur, for example, when either primary PAA 50A or secondary PAA 50B exhibits satisfactory wireless performance (e.g., wireless performance that exceeds a predetermined threshold) or when combined PAA 50' exhibits worse wireless performance than primary PAA 50A or secondary PAA 50B (e.g., when the wireless performance of primary PAA 50A or secondary PAA 50B is greater than or within a predetermined margin of the wireless performance of combined PAA 50'). The trigger condition may also occur when there is a corresponding application call by an application running on device 10, when the gathered wireless performance metric data and/or sensor data exhibits a predetermined value, when a user provides a user input instructing device 10 to switch operating modes, etc.

Figure 7:
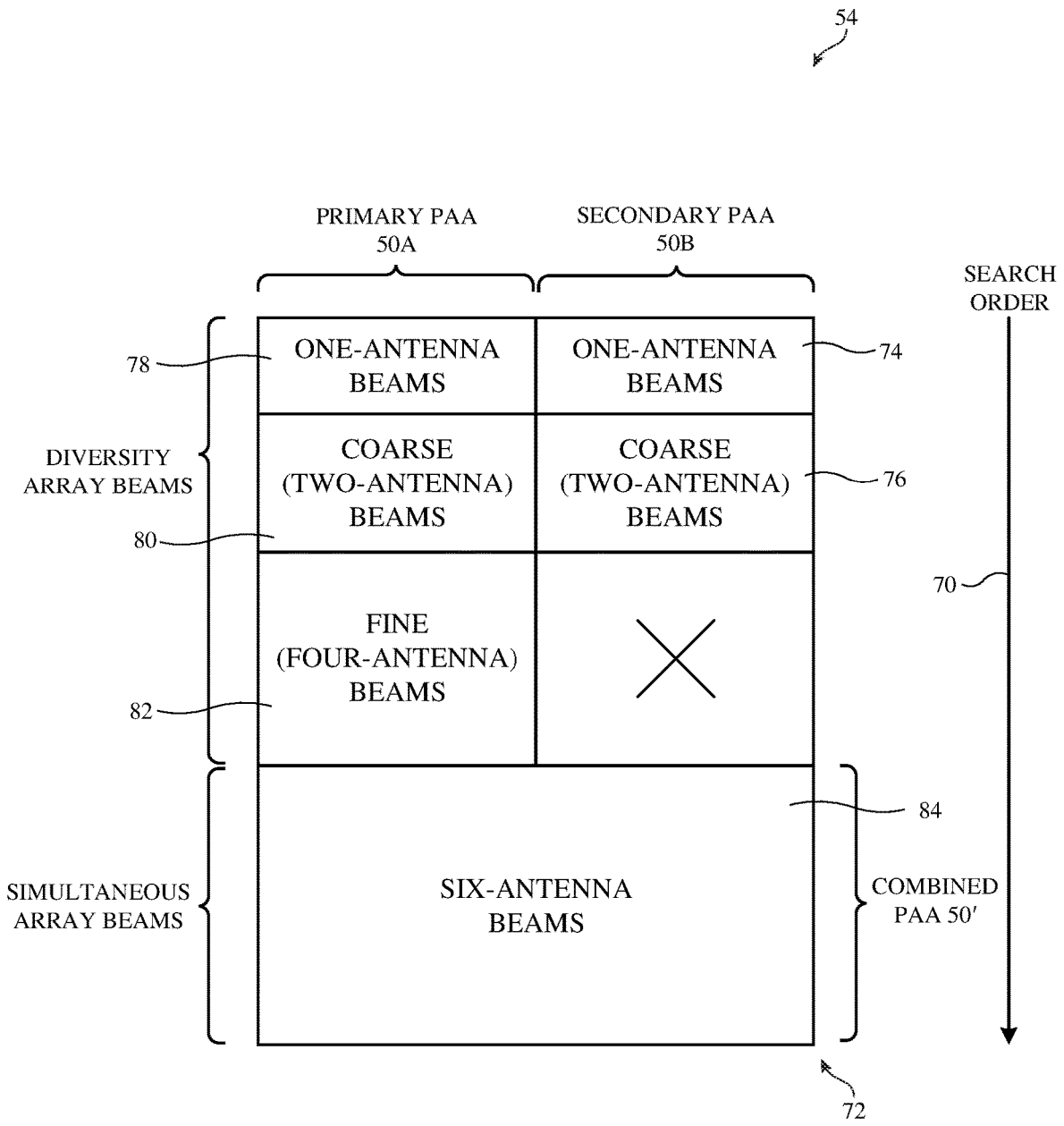
FIG. 7 is a diagram of an illustrative beam table for primary and secondary phased antenna arrays in accordance with some embodiments.

Codebook 54 (FIG. 5) may store each of the signal beams formable by primary PAA 50A, secondary PAA 50B, and combined PAA 50' within a corresponding beam table. FIG. 7 is a diagram of an illustrative beam table for primary PAA 50A, secondary PAA 50B, and combined PAA 50'. As shown in FIG. 7, codebook 54 may include beam table 72. Beam table 72 may be hard-coded into control circuitry 28 (FIG. 4) or elsewhere on device 10, may be stored in one or more look-up tables on control circuitry 28 or elsewhere on device 10, may be stored in a database or other data structure stored on device 10, etc.

Beam table 72 may include one or more blocks such as blocks 74, 76, 78, 80, 82, and 84. The relative size of each of these blocks generally corresponds to the number of formable signal beams contained by that block. Block 78 may identify the phase and magnitude settings (e.g., for phase and magnitude controllers 58 of FIG. 4) for forming signal beams using only one antenna 40 in primary PAA 50A. Block 80 may identify the phase and magnitude settings for forming signal beams using only one antenna 40 in secondary PAA 50B. As each of the signal beams identified by blocks 78 and 74 are produced using only a single antenna, each of the signal beams may correspond to a relatively low beam resolution (e.g., a wide beam width) and a relatively low gain.

Block 80 of beam table 72 may identify the phase and magnitude settings for forming signal beams using two antennas 40 in primary PAA 50A. Block 76 may identify the phase and magnitude settings for forming signal beams using two antennas 40 in secondary PAA 50B. As each of the signal beams identified by blocks 80 and 76 are produced using two antennas, each of the signal beams may be a relatively coarse signal beam having a beam resolution that is greater than the beam resolution of the signal beams identified by blocks 78 and 74 (e.g., signal beams having a beam width that is narrower than the beam width of the signal beams identified by blocks 78 and 74). Similarly, each of the signal beams identified by blocks 80 and 76 may have greater gain than the signal beams identified by blocks 78 and 74.

Block 82 of beam table 72 may identify the phase and magnitude settings for forming signal beams using four antennas 40 in primary PAA 50A (e.g., using every antenna 40 in primary PAA 50A). In this example, secondary PAA 50B only includes two antennas 40. As such, beam table 72 does not include any four-antenna beams for secondary PAA 50B. Since each of the signal beams identified by block 82 are produced using four antennas, each of the signal beams may be a relatively fine signal beam having a beam resolution that is greater than the beam resolution of the signal beams identified by blocks 80 and 76 (e.g., signal beams having a beam width that is narrower than the beam width of the signal beams identified by blocks 80 and 76). Similarly, each of the signal beams identified by block 82 may have greater gain than the signal beams identified by blocks 80 and 76. Blocks 78, 74, 76, 80, and 82 each identify signal beams that are produced by only one of primary PAA 50A or secondary PAA 50B. These signal beams may be used while the wireless circuitry is in diversity mode 62 of FIG. 6, for example, and may therefore sometimes be referred to herein as diversity array beams.

Block 84 of beam table 72 may identify the phase and magnitude settings for forming signal beams using combined PAA 50' (e.g., using every antenna 40 in primary PAA 50A and secondary PAA 50B). Each of the signal beams identified by block 84 may be a very fine signal beam having a beam resolution that is greater than the beam resolution of the signal beams identified by block 82 (e.g., signal beams having a beam width that is narrower than the beam width of the signal beams identified by block 82). Similarly, each of the signal beams identified by block 84 may have greater gain than the signal beams identified by block 82. In other words, block 84 identifies signal beams that are produced by the concurrent operation of the antennas 40 in primary PAA 50A and secondary PAA 50B (e.g., in forming a single signal beam across combined PAA 50'). These signal beams may be used while the wireless circuitry is in simultaneous array mode 60 of FIG. 6, for example, and may therefore sometimes be referred to herein as simultaneous array beams.

The example of FIG. 7 is merely illustrative. Beam table 72 may include additional blocks for forming beams using any desired number of antennas in one or both of primary PAA 50A and secondary PAA 50B. The simultaneous array beams need not be produced by every antenna in both primary PAA 50A and secondary PAA 50B and may, if desired, be produced using at least one antenna in primary PAA 50A and at least one antenna in secondar PAA 50B (e.g., beam table 72 may include multiple blocks of simultaneous array beams where each block corresponds to a different number of active antennas). Primary PAA 50A and secondary PAA 50B may be two dimensional arrays and beam table 72 may be adapted to include signal beams formed by antennas arranged in two dimensional patterns or any other patterns if desired.

Control circuitry 28 (FIG. 4) may perform beam searching operations to identify which of the signal beams in beam table 72 to use at any given time. The beam searching operations may be hierarchal and may generally proceed in an order from coarse to fine, as shown by arrow 70. This may allow the control circuitry to progressively home in on a signal beam that overlaps external wireless equipment, thereby minimizing the amount of time required to establish and maintain a wireless communication link with the external wireless communications equipment.

Figure 8:
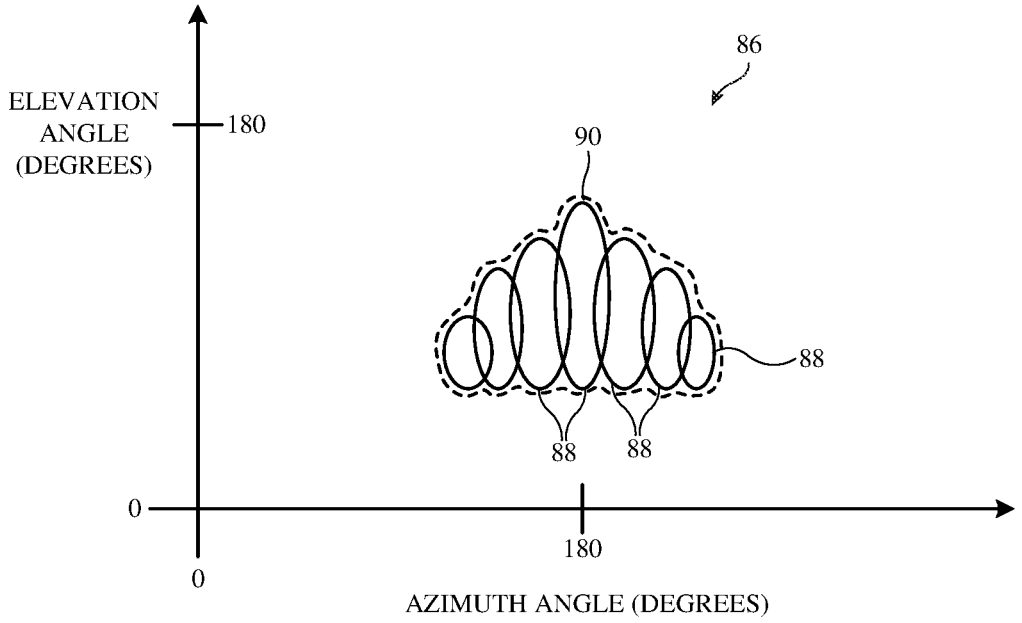
FIG. 8 is a cross-sectional plot of illustrative signal beams that may be formed by primary and secondary phased antenna arrays in accordance with some embodiments.
Figure 8:
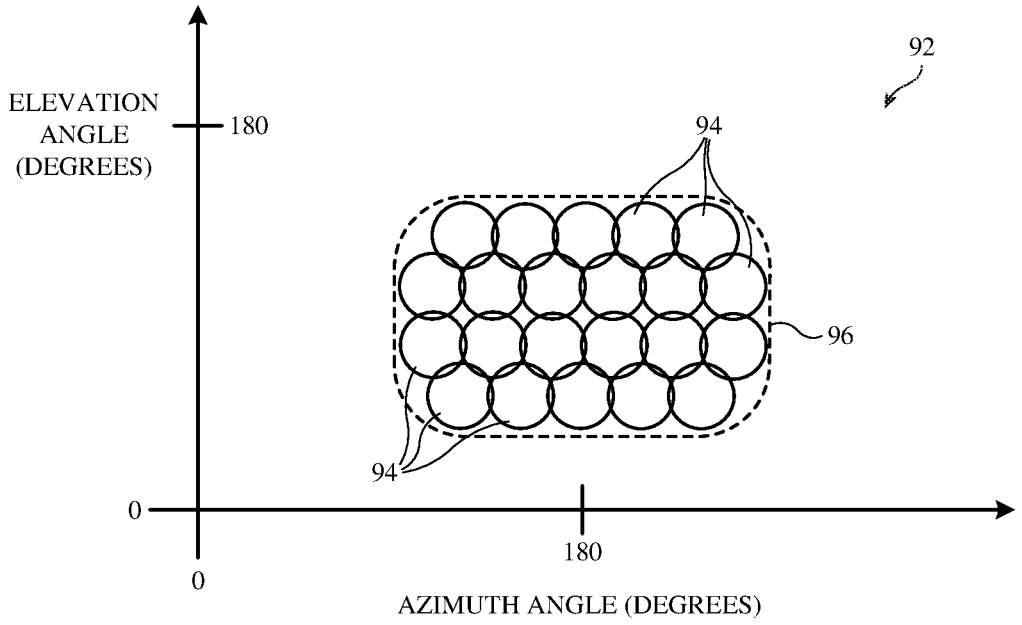

FIG. 8 shows plots (e.g., cross-sectional diagrams) of illustrative signal beams formable by primary PAA 50A and combined PAA 50' (e.g., signal beams as identified by beam table 72 of FIG. 7). The horizontal axes of FIG. 8 plot azimuth angle in degrees and the vertical axes of FIG. 8 plot elevation angle in degrees (e.g., within the hemisphere under rear housing wall 12R of FIG. 5).

Plot 86 of FIG. 8 shows exemplary signal beams 88 formed using all of the antennas 40 in primary PAA 50A. Signal beams 88 may, for example, be identified by block 82 of beam table 72 (FIG. 7). As shown by plot 86, signal beams 88 are relatively fine (narrow-width), high gain signal beams that collectively cover a relatively large region (envelope) 90 within the hemisphere overlapping primary PAA 50A. Control circuitry 28 (FIG. 4) may select a given signal beam 88 to use at any given time (e.g., the signal beam 88 that overlaps the position of external wireless communications equipment).

Plot 92 of FIG. 8 shows exemplary signal beams 94 formed using all of the antennas 40 in combined PAA 50' (e.g., using all of the antennas in both primary PAA 50A and secondary PAA 50B). Signal beams 94 may, for example, be identified by block 84 of beam table 72 (FIG. 7). As shown by plot 92, signal beams 94 are very fine (narrow-width), very-high gain signal beams. The signal beams 94 may collectively cover a relatively large region (envelope) 96 within the hemisphere overlapping combined PAA 50'. Region 96 may be larger and/or more uniform in shape than region 90, for example. Because signal beams 94 are smaller (higher gain) than signal beams 88, beam table 72 may store more signal beams 94 than signal beams 88 (e.g., block 84 of FIG. 7 may be larger than block 82). Control circuitry 28 (FIG. 4) may select a given signal beam 94 to use at any given time (e.g., the signal beam 94 that overlaps the position of external wireless communications equipment).

The example of FIG. 8 is merely illustrative. In general, signal beams 88 and 94 and regions 90 and 96 may have other shapes or sizes. Region 96 may include any desired number of signal beams 94. Region 90 may include any desired number of signal beams 88. Regions 96 and 90 may span other ranges of azimuth angle and elevation angle.

Figure 9:
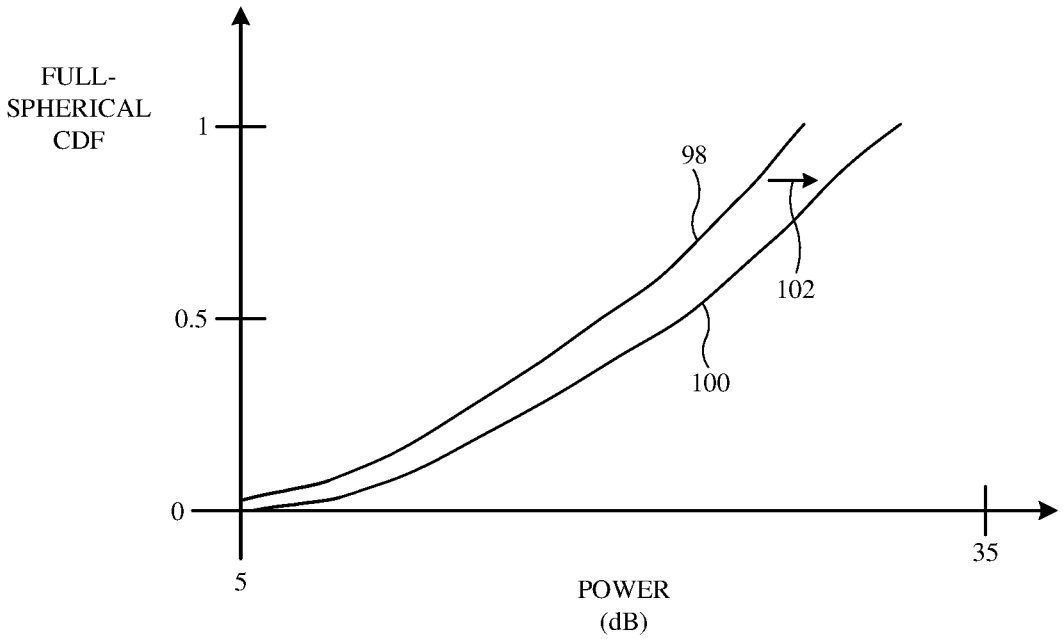
FIG. 9 is a plot showing how operating primary and secondary phased antenna array as a single combined phased antenna array may optimize wireless performance in accordance with some embodiments.

FIG. 9 is a plot showing how combined PAA 50' may optimize wireless performance for device 10. The horizontal axis of FIG. 9 plots power in dB (e.g., EARP). The vertical axis of FIG. 9 plots full-spherical cumulative distribution function (CDF). Curve 98 plots the wireless performance of either primary PAA 50A or secondary PAA 50B (e.g., operating in diversity mode 62 of FIG. 6). Curve 100 plots the wireless performance of combined PAA 50' (e.g., operating in simultaneous array mode 60 and producing signal beams 94 of FIG. 8). Conveying radio-frequency signals using combined PAA 50' may improve the wireless performance of device 10 relative to conveying radio-frequency signals using only primary PAA 50A or secondary PAA 50B, as shown by arrow 102 (e.g., by as much as 3 dB or greater).

Figure 10:
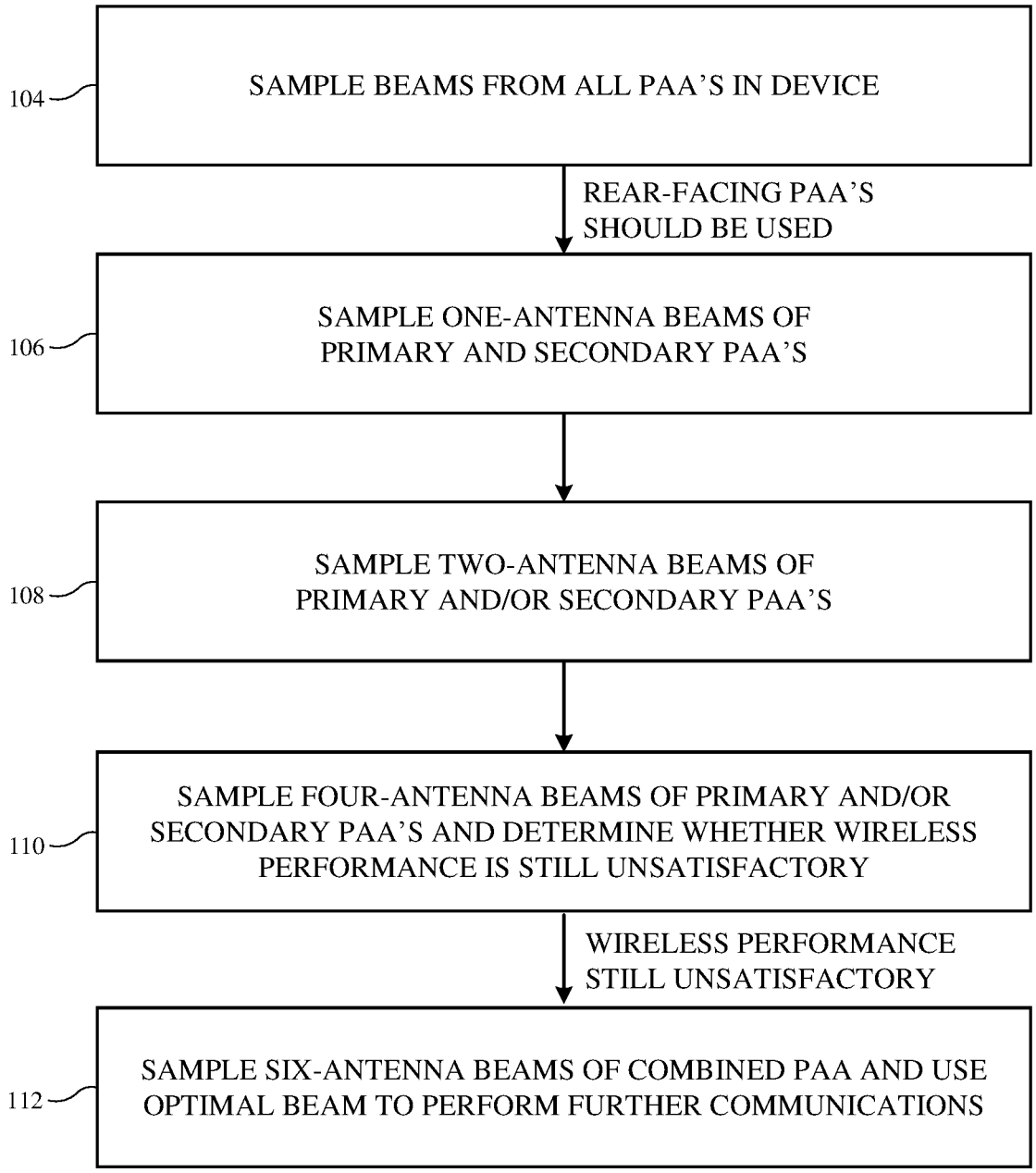
FIG. 10 is a flow chart of illustrative steps for performing beam searching operations using primary and secondary phased antenna arrays in accordance with some embodiments.

FIG. 10 is a flow chart of illustrative steps that may be processed by control circuitry 28 (FIG. 4) in performing beam searching operations (e.g., using beam table 72 and proceeding in the direction of arrow 70 of FIG. 7). At step 104 of FIG. 10, control circuitry 28 may sample beams from all of the phased antenna arrays in device 10. For example, control circuitry 28 may produce one or more signal beams using each of the phased antenna arrays and may gather wireless performance metric data for each of the signal beams. Control circuitry 28 may process the wireless performance metric data to identify one or more phased antenna arrays to use for further communications (e.g., phased antenna arrays having wireless performance metric data that exceeds a threshold value).

In response to determining that one of primary PAA 50A or secondary PAA 50B should be used (e.g., a rear-facing phased antenna array that radiates through rear housing wall 12R), processing may proceed to step 106. Control circuitry 28 may determine that primary PAA 50A or secondary PAA 50B should be used when primary PAA 50A or secondary PAA 50B exhibits greater wireless performance (e.g., as identified by the gathered wireless performance metric data) than the other phased antenna arrays in device 10 or when primary PAA 50A or secondary PAA 50B has wireless performance metric data that exceeds a threshold value.

At step 106, control circuitry 28 may sample (e.g., sweep through) single-antenna beams for primary PAA 50A and secondary PAA 50B. For example, control circuitry 28 may produce one or more of the signal beams identified by blocks 78 and 74 of FIG. 7. Control circuitry 28 may gather wireless performance metric data for each of the signal beams. Because these signal beams are single-antenna beams, the signal beams are relatively wide and low-gain. The wireless performance metric data may, for example, identify a general direction of the external wireless equipment. Control circuitry 28 may identify a single-antenna beam having the best wireless performance (e.g., based on the gathered wireless performance metric data) for further processing.

At step 108, control circuitry 28 may sample (e.g., sweep through) two-antenna beams for the phased antenna array that produced the single-antenna beam having the best wireless performance (e.g., as identified at step 106). For example, if the single-antenna beam having the best wireless performance was produced by primary PAA 50A, control circuitry 28 may sample two-antenna beams as identified by block 80 of FIG. 7. Control circuitry 28 may gather wireless performance metric data for each of the signal beams. The wireless performance metric data may, for example, identify a more precise direction of the external wireless equipment than was identified using the single-antenna beams. Control circuitry 28 may identify the two-antenna beam having the best wireless performance (e.g., based on the gathered wireless performance metric data) for further processing.

At step 110, control circuitry 28 may sample four-antenna beams (e.g., signal beams 88 of FIG. 8) for the phased antenna array that produced the two-antenna beam having the best wireless performance (e.g., as identified at step 108). For example, if the two-antenna beam having the best wireless performance was produced by primary PAA 50A, control circuitry 28 may sample four-antenna beams as identified by block 82 of FIG. 7. If desired, to minimize processing time, the sampled four-antenna beams may be only those four-antenna beams overlapping or adjacent the identified two-antenna beam having the best wireless performance. Control circuitry 28 may identify the four-antenna beam having the best wireless performance (e.g., based on the gathered wireless performance metric data) for further processing.

If desired, control circuitry 28 may determine whether the identified four-antenna beam having the best wireless performance has satisfactory wireless performance. The four-antenna beam may have satisfactory wireless performance if the wireless performance metric data gathered for that four-antenna beam exceeds a threshold level, for example. If the wireless performance metric data gathered for the four-antenna beam exceeds the threshold level, that four-antenna beam may be used to perform further communications with the external wireless equipment.

In the example of FIG. 10, steps 104-110 are performed while the wireless circuitry is in diversity mode 62 of FIG. 6. If the wireless performance metric data gathered for the four-antenna beam is less than the threshold level, processing may proceed to step 112. This may, for example, be indicative of the four-antenna beam not exhibiting sufficient gain to establish a reliable wireless link with the external wireless equipment. Control circuitry 28 may subsequently place device 10 in simultaneous array mode 60 of FIG. 6.

At step 112 (e.g., in simultaneous array mode 60 of FIG. 6), control circuitry 28 may sample (e.g., sweep through) signal beams for combined array 50'. In the example where combined array 50' includes six antennas, control circuitry 28 may sample six-antenna signal beams (e.g., signal beams 94 of FIG. 8) as identified by block 84 of FIG. 7. If desired, to minimize processing time, the sampled six-antenna beams may be only those six-antenna beams overlapping or adjacent the identified four-antenna beam having the best wireless performance. Control circuitry 28 may identify the six-antenna beam having the best wireless performance (e.g., based on the gathered wireless performance metric data) as the optimal signal beam for performing further communications. Control circuitry 28 may subsequently use the optimal signal beam to communicate with the external wireless equipment. If desired, processing may loop back to step 104 when the wireless performance metric data gathered for the optimal signal beam falls below a threshold value (e.g., when the external wireless equipment moves away from the area subtended by the optimal signal beam).

The example of FIG. 10 is merely illustrative. Other beam searching operations can be used. If desired, control circuitry 28 may periodically check the signal beams used at one or more of the steps of FIG. 10 and/or the optimal signal beam identified at step 112 to determine whether the active signal beam needs to be adjusted (e.g., to determine whether the signal beam needs to be steered to a new beam pointing direction, to determine whether device 10 needs to transition between diversity mode 62 or simultaneous array mode 60 of FIG. 6, etc.). Any desired trigger condition such as the gathered wireless performance metric data falling below a predetermined threshold level may trigger a new beam searching operation, a switch between the diversity mode and the simultaneous array mode, a switch between the active phased antenna array within the diversity mode, etc. As one example, if primary PAA 50A is being used to sample two-antenna beams (at step 108) or four-antenna beams (at step 110) and the gathered wireless performance metric data identifies a drop in beam power that exceeds a threshold level, this may indicate that primary PAA 50A has become blocked by an external object. Control circuitry 28 may subsequently switch secondary PAA 50B into use and may subsequently perform wireless communications and/or beam searching operations using secondary PAA 50B (e.g., until primary PAA 50A is no longer blocked by the external object). Sensor data may also be used to determine whether primary PAA 50A has become blocked by an external object.

Figure 11:
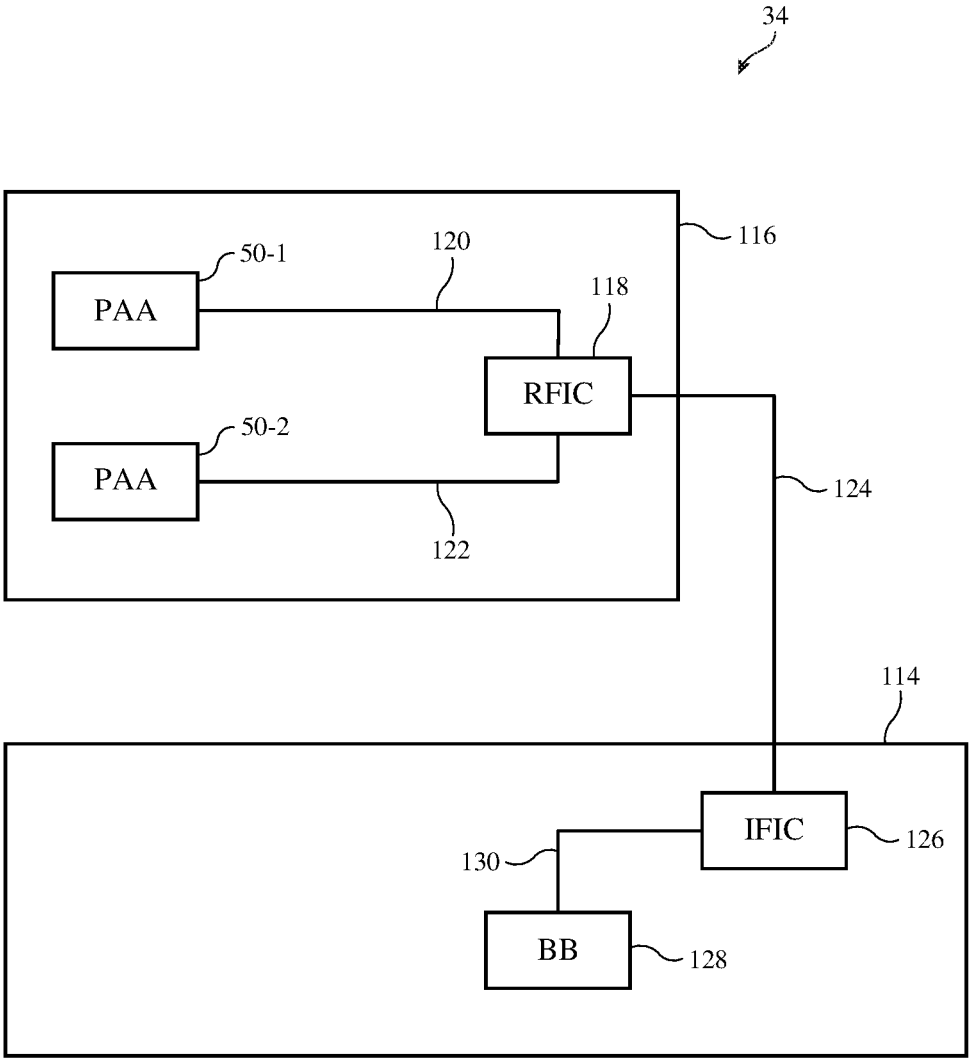
FIG. 11 is diagram showing how illustrative first and second phased antenna arrays may be formed on the same antenna module in accordance with some embodiments.

If desired, primary PAA 50A and secondary PAA 50B may be combined within the same antenna module. FIG. 11 is a diagram showing how the phased antenna arrays may be combined within the same antenna module. As shown in FIG. 11, wireless circuitry 34 may include an antenna module or package such as antenna module 116. The components of antenna module 116 may be mounted to a common (shared) antenna module substrate such as a rigid printed circuit board substrate or a flexible printed circuit substrate. The components in antenna module 116 may be mounted to the antenna module substrate using surface-mount technology (SMT), solder balls, conductive pins, a ball grid array, etc.

A radio-frequency integrated circuit (RFIC) such as RFIC 118 may be mounted to the antenna module substrate. A first phased antenna array (PAA) 50-1 (e.g., primary PAA 50A or secondary PAA 50B) and a second PAA 50-2 (e.g., secondary PAA 50B or primary PAA 50A) may also be formed on the antenna module substrate. RFIC 118 may be coupled to PAA 50-1 over radio-frequency paths 120. RFIC 118 may be coupled to PAA 50-2 over radio-frequency paths 122. Radio-frequency paths 120 and 122 may include radio-frequency transmission line paths (e.g., radio-frequency transmission line paths 42 of FIG. 4) that convey radio-frequency signals.

RFIC 118 may be coupled to an intermediate frequency integrated circuit (IFIC) 126 over intermediate frequency (IF) path 124. RFIC 118 and IFIC 126 may collectively form millimeter/centimeter wave transceiver circuitry 38 (FIG. 2). IFIC 126 and RFIC 118 may convey IF signals over IF path 124. Conveying signals at intermediate frequencies may incur less loss than conveying signals at millimeter/centimeter wave frequencies. RFIC 118 may include mixer circuitry (e.g., upconversion and downconversion circuitry) that converts the IF signals from IF frequencies into radio-frequency signals at radio-frequencies for transmission over PAA 50-1 and PAA 50-2. Similarly, the mixer circuitry in RFIC 118 may convert the radio-frequency signals at radio-frequencies into IF signals at IF frequencies for transmission to IFIC 126 over IF path 124. RFIC 118 may also include the phase and magnitude controllers for PAA 50-1 and PAA 50-2 (e.g., phase and magnitude controllers 58 of FIG. 4).

IFIC 126 may include mixer circuitry (e.g., upconversion and downconversion circuitry) that converts the IF signals received over IF path 124 into baseband signals at a baseband frequency for transmission to baseband (BB) processor 128 over baseband path 130. Similarly, the mixer circuitry in IFIC 126 may convert baseband signals received over baseband path 130 into IF signals for transmission over IF path 124. Power and control signals may also be conveyed over IF path 124.

In the example of FIG. 11, IFIC 126, baseband processor 128, baseband path 130, and a portion of IF path 124 are formed on an underlying substrate 114 (e.g., a rigid printed circuit board, flexible printed circuit, etc.) that is separate from the antenna module substrate of antenna module 116. In one suitable arrangement that is sometimes described herein as an example, substrate 114 may be a main logic board for device 10. Substrate 114 may therefore sometimes be referred to herein as main logic board (MLB) 114. By forming both PAA 50-1 and PAA 50-2 on the same antenna module 116 and by sharing RFIC 118 between PAA 50-1 and PAA 50-2 in this way, the cost, manufacturing complexity, and routing complexity of wireless circuitry 34 may be minimized. In addition, by simplifying the interconnections between baseband processor 128 and the phased antenna arrays in this way, wireless circuitry 34 may exhibit reduced impedance mismatch loss, reduced transmission line loss, and increased reliability, as examples. If desired, flexible printed circuit boards may be used to couple any antenna modules external to MLB 114 (e.g., for forming IF path 124 of FIG. 11).

Figure 12:
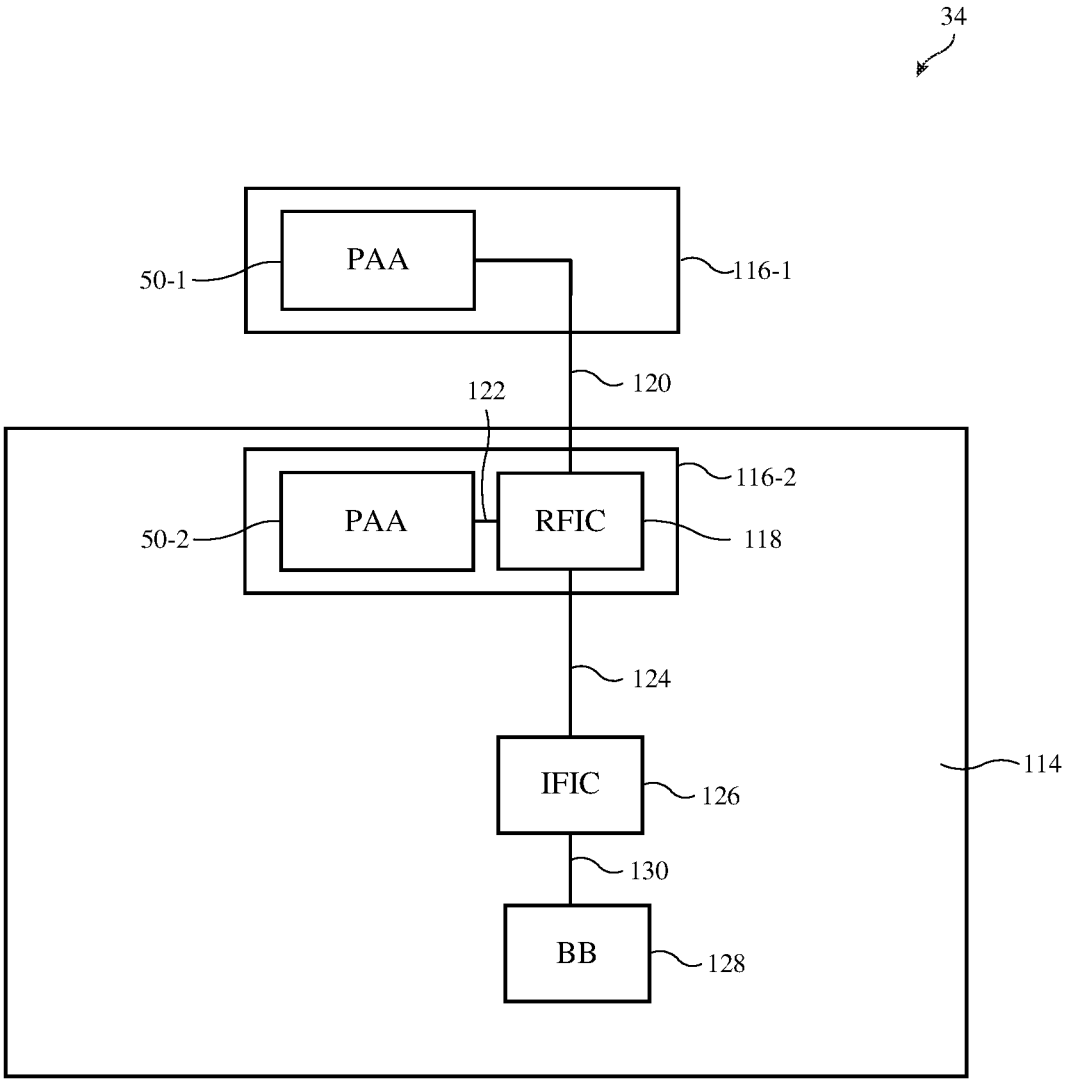
FIG. 12 is a diagram showing how an illustrative radio-frequency integrated circuit may feed first and second phased antenna arrays in accordance with some embodiments.

The example of FIG. 11 is merely illustrative. If desired, PAA 50-1 and PAA 50-2 may be formed on separate antenna modules. FIG. 12 is a diagram showing one example of how PAA 50-1 and PAA 50-2 may be formed on separate antenna modules. As shown in FIG. 12, PAA 50-1 may be formed on a first antenna module 116-1 whereas PAA 50-2 is formed on a second antenna module 116-2 (e.g., antenna module 116-1 may have a first antenna module substrate whereas antenna module 116-2 has a second antenna module substrate that is separate from the first antenna module substrate). RFIC 118 may be mounted (e.g., surface-mounted) to antenna module 116-2.

In the example of FIG. 12, antenna module 116-2 is mounted (e.g., surface-mounted) to MLB 114. This is merely illustrative and, in another suitable arrangement, antenna module 116-2 may be separate from MLB 114. Forming antenna module 116-1 separate from MLB 114 may allow antenna module 116-1 to be flexibly placed at a desired location within device 10. Mounting antenna module 116-2 to MLB 114 may allow the corresponding radio-frequency traces (e.g., portions of radio-frequency paths 122 and/or 120), IF traces (e.g., portions of IF path 124), control traces (e.g., in IF path 124), and power traces (e.g., in IF path 124) to be integrated within the routing of MLB 114. Board-to-board (B2B) connectors, flex traces, and/or radio-frequency traces may be used to couple RFIC 118 to antenna module 116-1.

Figure 13:
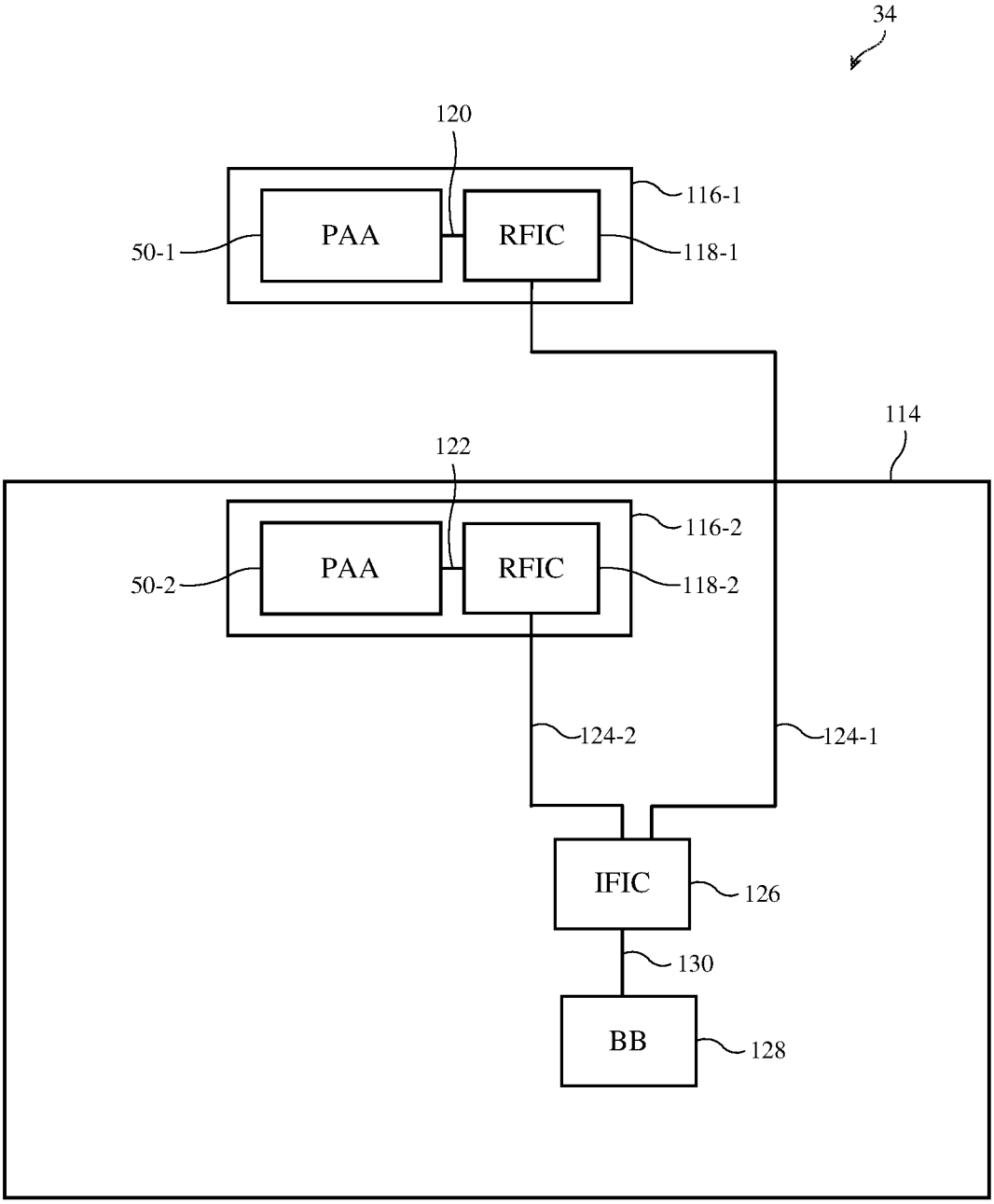
FIGS. 13 and 14 are diagrams showing how illustrative first and second phased antenna arrays may be fed by respective radio-frequency integrated circuits in accordance with some embodiments.
Figure 14:
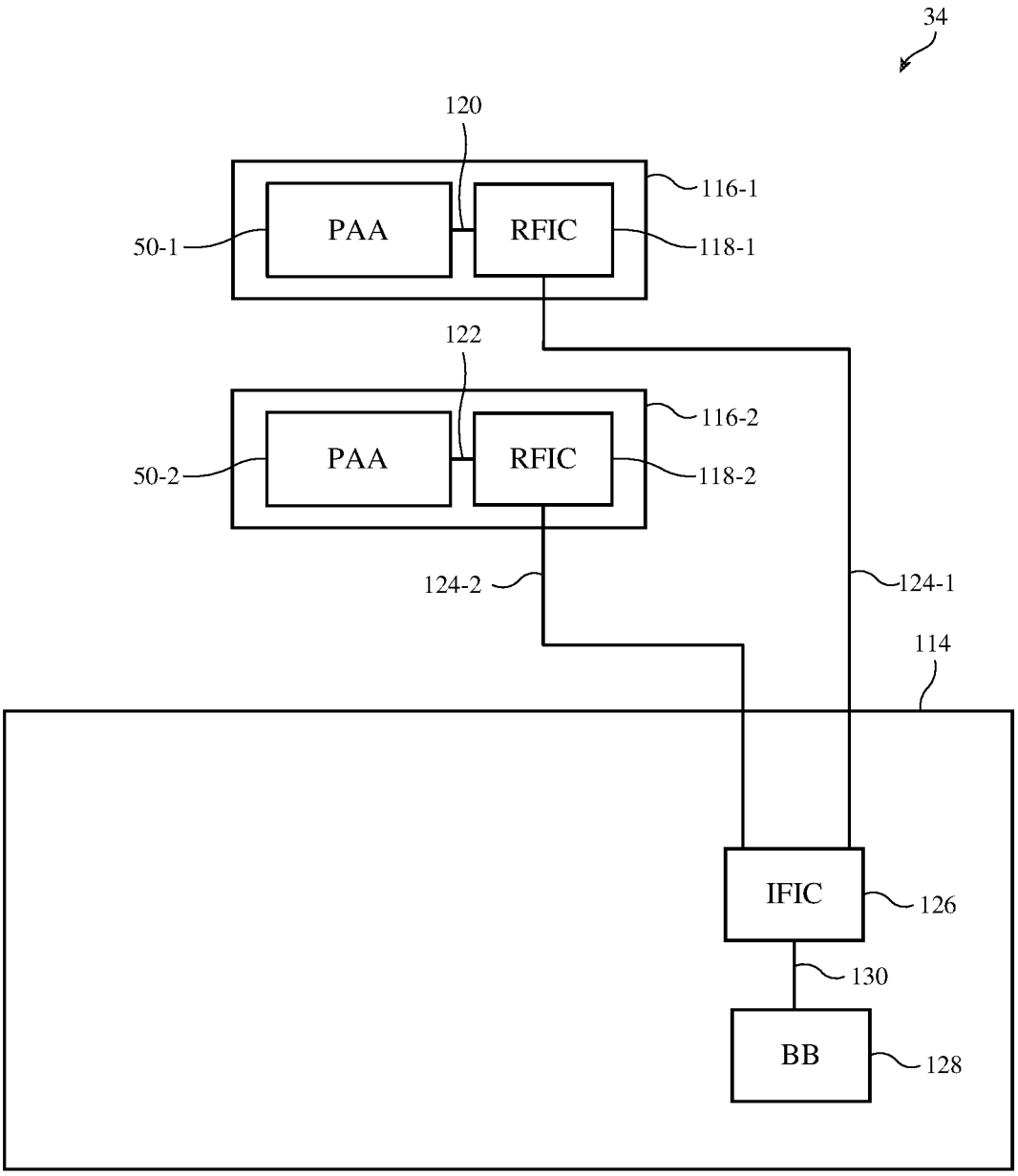

The arrangement of FIG. 12 in which the same RFIC 118 is shared by both PAA 50-1 and PAA 50-2 is merely illustrative. In another suitable arrangement, PAA 50-1 and PAA 50-2 may each be fed by a respective RFIC. As shown in FIG. 13, a first RFIC such as RFIC 118-1 may be mounted to antenna module 116-1. A second RFIC such as RFIC 118-2 may be mounted to antenna module 116-2. IFIC 126 may be coupled to RFIC 118-1 over IF path 124-1. IFIC 126 may be coupled to RFIC 118-2 over IF path 124-2. IF signals, control signals, and power signals may be conveyed over IF paths 124-1 and 124-2.

Figure 15:
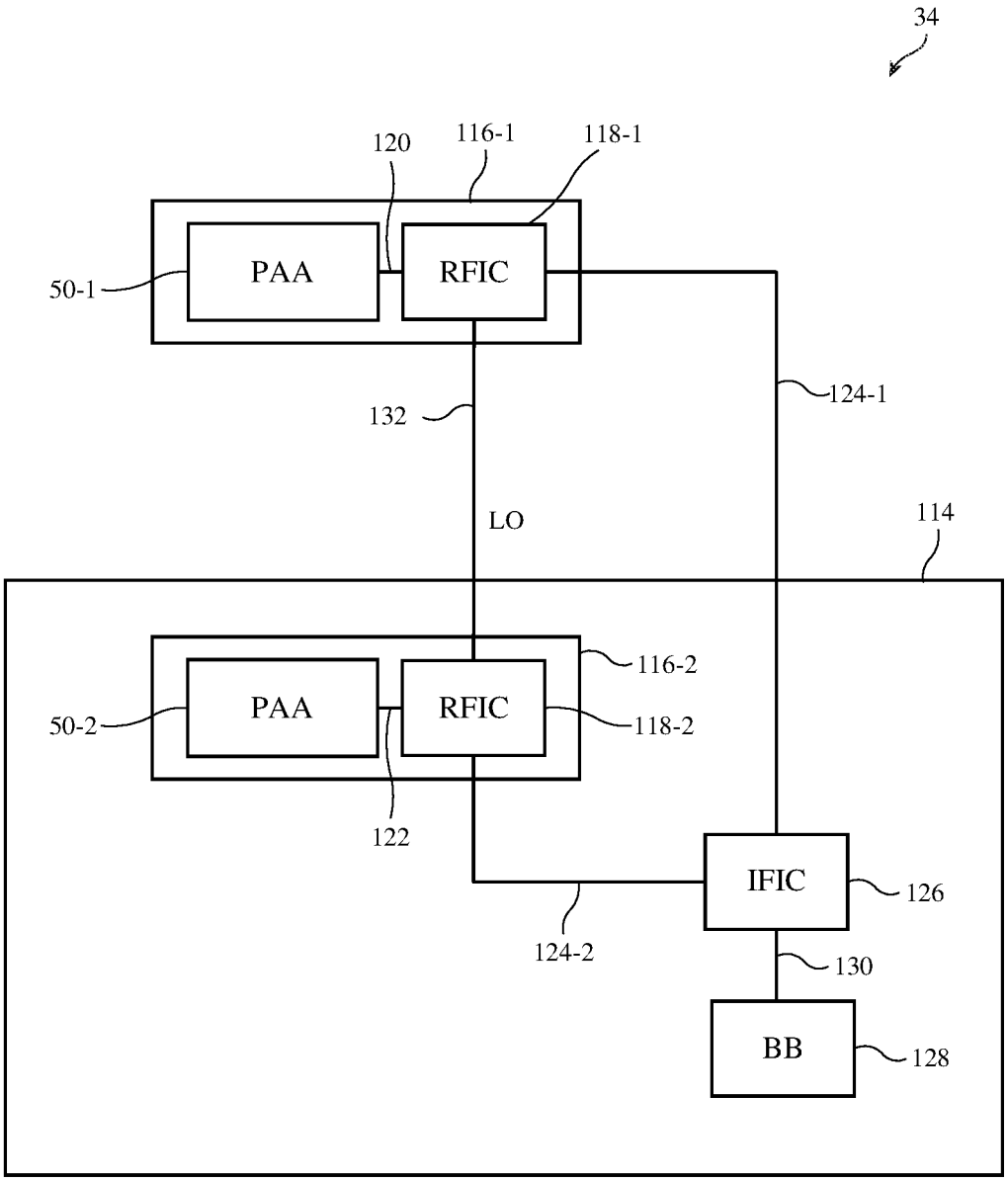
FIG. 15 is a diagram showing how illustrative first and second antenna arrays may share a local oscillator signal in accordance with some embodiments.

The example of FIG. 13 in which antenna module 116-2 is mounted to MLB 114 is merely illustrative. In another suitable arrangement, antenna module 116-2 may be formed external to MLB 114, as shown in FIG. 15. This may, for example, allow for maximum flexibility in the placement of PAA 50-1 and PAA 50-2 within device 10.

If desired, RFIC 118-2 may provide timing (clock) signals such as a local oscillator signal to RFIC 118-1. FIG. 15 is a diagram showing how RFIC 118-2 may provide a local oscillator signal to RFIC 118-1. As shown in FIG. 15, RFIC 118-2 may be coupled to RFIC 118-1 over local oscillator path 132. RFIC 118-2, other portions of antenna module 116-2, or MLB 114 may include a local oscillator generator that produces local oscillator signal LO. RFIC 118-2 may transmit local oscillator signal LO to RFIC 118-1 over local oscillator path 132. RFIC 118-1 and RFIC 118-2 may each use local oscillator signal LO for performing upconversion and downconversion and/or for performing other timing operations associated with the transmission and/or reception of radio-frequency signals using PAA 50-1 and PAA 50-2. By sharing local oscillator signal LO between RFIC 118-1 and RFIC 118-2, the operation of PAA 50-1 and PAA 50-2 may be synchronized. This synchronization may, for example, support coherence between the antennas in PAA 50-1 and PAA 50-2 when PAA 50-1 and PAA 50-2 are being used as a single combined PAA 50' (FIG. 5).

In scenarios where RFIC 118-2 provides local oscillator signal LO to RFIC 118-1, RFIC 118-2 operates as a master RFIC whereas RFIC 118-1 operates as a slave RFIC. This is merely illustrative. In another suitable arrangement, RFIC 118-1 may operate as a master RFIC and may produce local oscillator signal LO for RFIC 118-2 (e.g., RFIC 118-2 may be a slave RFIC).

The examples of FIGS. 11-15 are merely illustrative. If desired, any of the arrangements of FIGS. 11-15 may be combined. Wireless circuitry 34 may include more than two phased antenna arrays (e.g., three or more phased antenna arrays operable in a diversity mode of operation and in a simultaneous array mode of operation in which each of the phased antenna arrays operate as a single combined phased antenna array as described above in connection with FIGS. 5-10). The phased antenna arrays may be formed on respective antenna modules or two or more (e.g., all) of the phased antenna arrays may be formed on the same antenna module.

Figure 16:
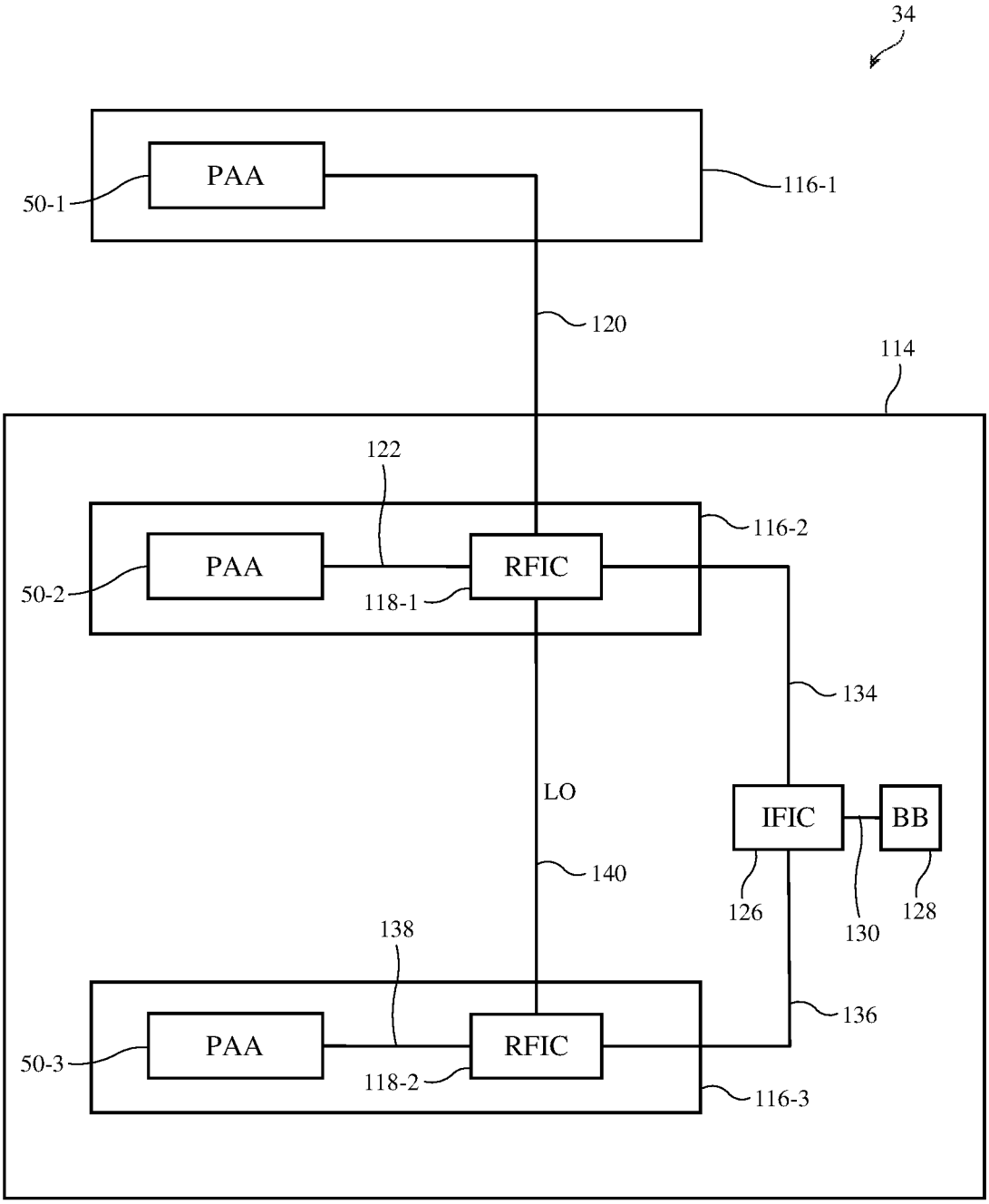
FIG. 16 is a diagram showing how illustrative wireless circuitry may include first, second, and third phased antenna arrays in accordance with some embodiments.

FIG. 16 is a diagram showing one example of how wireless circuitry 34 may include three phased antenna arrays. As shown in FIG. 16, wireless circuitry 34 may include a first PAA 50-1 on first antenna module 116-1, a second PAA 50-2 on second antenna module 116-2, and a third PAA 50-3 on third antenna module 116-3. Antenna module 116-2 and antenna module 116-3 may be mounted to MLB 114. A first RFIC 118-1 may be mounted to antenna module 116-2 and may be shared by PAA 50-1 and PAA 50-2 (e.g., RFIC 118-1 may be coupled to PAA 50-1 by radio-frequency paths 120 and may be coupled to PAA 50-2 by radio-frequency paths 122). A second RFIC 118-2 may be mounted to antenna module 116-3. RFIC 118-2 may be used to feed PAA 50-3. IFIC 126 may be coupled to RFIC 118-1 over IF path 134. IFIC may be coupled to RFIC 118-2 over IF path 136. IF signals, control signals, and power signals may be conveyed over IF paths 134 and 136.

RFIC 118-2 may be coupled to RFIC 118-1 over LO path 140. RFIC 118-2 may generate local oscillator signal LO and may transmit local oscillator signal LO to RFIC 118-1 over LO path 140. The example of FIG. 16 is merely illustrative. If desired, RFIC 118-1 may generate local oscillator signal LO. Any desired combination of antenna modules 116-1, 116-2, and 116-3 may be mounted to MLB 114 or formed external to MLB 114. Each antenna module 116 may have a respective RFIC or one or more antenna module may share one or more RFIC. Each antenna module 116 may include one or more phased antenna arrays. Wireless circuitry 34 may include more than three phased antenna arrays and/or more than three antenna modules if desired.

Device 10 may gather and/or use personally identifiable information. It is well understood that the use of personally identifiable information should follow privacy policies and practices that are generally recognized as meeting or exceeding industry or governmental requirements for maintaining the privacy of users. In particular, personally identifiable information data should be managed and handled so as to minimize risks of unintentional or unauthorized access or use, and the nature of authorized use should be clearly indicated to users.

The foregoing is merely illustrative and various modifications can be made by those skilled in the art without departing from the scope and spirit of the described embodiments. The foregoing embodiments may be implemented individually or in any combination.

What is claimed is:

1. An electronic device comprising:

a first phased antenna array;

a second phased antenna array having fewer antennas than the first phased antenna array, the first and second phased antenna arrays being configured to convey radio-frequency signals at a frequency greater than 10 GHz; and control circuitry coupled to the first and second phased antenna arrays, wherein the control circuitry is configured to operate the first and second phased antenna arrays in:

a first mode in which the first phased antenna array forms a first signal beam at a first beam pointing angle while the second phased antenna array is inactive, a second mode in which antennas from both the first phased antenna array and the second phased antenna array form a second signal beam at a second beam pointing angle, and a third mode in which the second phased antenna array forms a third signal beam at a third beam pointing angle while the first phased antenna array is inactive; and a beam table that identifies a first set of signal beams for use in the first mode, a second set of signal beams for use in the second mode, and a third set of signal beams for use in the third mode, the first set of signal beams being larger than the third set of signal beams, and the second set of signal beams being larger than the first set of signal beams.

2. The electronic device of claim 1, wherein the control circuitry is configured to gather wireless performance metric data associated with the first signal beam and is configured to transition the first and second phased antenna arrays from the first mode to the third mode when the gathered wireless performance metric data falls below a threshold level.

3. The electronic device of claim 1, further comprising:

a sensor configured to gather sensor data, wherein the control circuitry is configured to transition the first and second phased antenna arrays from the first mode to the third mode when the gathered sensor data indicates that an external object is blocking the first phased antenna array.

4. The electronic device of claim 1, wherein the first set of signal beams comprises signal beams formable using an entirety of the first phased antenna array, the control circuitry being configured to:

sample each of the signal beams formable using the entirety of the first phased antenna array while gathering wireless performance metric data; and transition the first and second phased antenna arrays from the first mode to the second mode when the gathered wireless performance metric data is below a threshold level.

5. The electronic device of claim 1, further comprising:

peripheral conductive housing structures;

a display mounted to the peripheral conductive housing structures; and a rear housing wall mounted to the peripheral conductive housing structures opposite the display, the first and second phased antenna arrays being configured to radiate through the rear housing wall.

6. The electronic device of claim 5, further comprising:

a main logic board;

a baseband processor mounted to the main logic board;

an intermediate frequency integrated circuit (IFIC) mounted to the main logic board and coupled to the baseband processor over a baseband path; and a radio-frequency integrated circuit (RFIC) coupled to the first phased antenna array, the RFIC being coupled to the IFIC over an intermediate frequency (IF) path.

7. The electronic device of claim 6, further comprising:

an antenna module, wherein the first and second phased antenna arrays and the RFIC are on antenna module.

8. The electronic device of claim 6, further comprising:

a first antenna module mounted to the main logic board, wherein the first phased antenna array and the RFIC are on the first antenna module; and a second antenna module external to the main logic board, wherein the second phased antenna array is on the second antenna module and the RFIC is coupled to the second phased antenna array over a radio-frequency path.

9. The electronic device of claim 6, further comprising:

an additional RFIC coupled to the second phased antenna array, wherein the IFIC is coupled to the additional RFIC over an additional IF path;

a first antenna module mounted to the main logic board, wherein the RFIC and the first phased antenna array are on the first antenna module; and a second antenna module external to the main logic board, wherein the second phased antenna array and the additional RFIC are on the second antenna module.

10. The electronic device of claim 9, wherein the RFIC is coupled to the additional RFIC over a local oscillator path, the RFIC being configured to generate a local oscillator signal and being configured to transmit the local oscillator signal to the additional RFIC over the local oscillator path.

11. The electronic device of claim 6, further comprising:

an additional RFIC coupled to the second phased antenna array, wherein the IFIC is coupled to the additional RFIC over an additional IF path;

a first antenna module external to the main logic board, wherein the RFIC and the first phased antenna array are on the first antenna module; and a second antenna module external to the main logic board, wherein the second phased antenna array and the additional RFIC are on the second antenna module.

12. The electronic device of claim 6, further comprising:

an additional RFIC coupled to the second phased antenna array, wherein the IFIC is coupled to the additional RFIC over an additional IF path;

a first antenna module mounted to the main logic board, wherein the RFIC and the first phased antenna array are on the first antenna module;

a second antenna module on the main logic board, wherein the second phased antenna array and the additional RFIC are on the second antenna module;

a third antenna module external to the main logic board; and a third phased antenna array on the third antenna module and coupled to the additional RFIC over a radio-frequency path, wherein the RFIC is coupled to the additional RFIC over a local oscillator path, the RFIC being configured to generate a local oscillator signal and being configured to transmit the local oscillator signal to the additional RFIC over the local oscillator path.

13. An electronic device comprising: a housing wall; a first phased antenna array; a second phased antenna array having fewer antennas than the first phased antenna array, wherein the first and second phased antenna arrays are configured to radiate at a frequency greater than 10 GHz through the housing wall; and control circuitry coupled to the first and second phased antenna arrays and configured to: sample a first set of signal beams, generated by the first phased antenna array while the second phased antenna array is inactive and generated by the second phased antenna array while the first phased antenna array is inactive, in an order from coarser beams to finer beams; and sample a second set of signal beams generated by a combined phased antenna array formed from the first and second phased antenna arrays subsequent to sampling the first set of signal beams.

14. The electronic device of claim 13, wherein the first phased antenna array has first, second, third, and fourth antennas, the second phased antenna has fifth and sixth antennas, and the combined phased antenna array comprises the first, second, third, fourth, fifth, and sixth antennas.

15. The electronic device of claim 14, wherein the control circuitry is configured to:

sample one-antenna signal beams of the first and second phased antenna arrays;

sample two-antenna signal beams of the first and second phased antenna arrays subsequent to sampling the one-antenna signal beams;

sample four-antenna signal beams of the first phased antenna array subsequent to sampling the two-antenna signal beams; and sample six-antenna signal beams of the combined phased antenna array subsequent to sampling the four-antenna signal beams.

16. The electronic device of claim 13, wherein the control circuitry is configured to gather wireless performance metric data associated with the first set of signal beams and is configured to control the first and second phased antenna arrays to form the combined phased antenna array in response to the wireless performance metric data being less than a threshold level.

17. An electronic device comprising:

a logic board;

a baseband processor mounted to the logic board;

an intermediate frequency integrated circuit (IFIC) mounted to the logic board and coupled to the baseband processor over a baseband path;

a first antenna module, the first antenna module having a first phased antenna array and a first radio-frequency integrated circuit (RFIC) coupled to the first phased antenna array;

a second antenna module on the logic board, the second antenna module having a second phased antenna array and a second RFIC coupled to the second phased antenna array, the first and second phased antenna arrays being configured to convey radio-frequency signals at a frequency greater than 10 GHz, wherein the IFIC is coupled to the second RFIC over an intermediate frequency path; and a third antenna module external to the logic board and having a third phased antenna array that is coupled to the second RFIC over a radio-frequency path, wherein the first RFIC is coupled to the second RFIC over a local oscillator path, and the first and second RFICs share a local oscillator signal over the local oscillator path.

18. The electronic device defined in claim 17 wherein the first antenna module is on the logic board and the IFIC is coupled to the first RFIC over an additional intermediate frequency path.

* * * * *